US009598947B2

(12) United States Patent
Wang et al.

(10) Patent No.: US 9,598,947 B2
(45) Date of Patent: Mar. 21, 2017

(54) AUTOMATIC DRILLING ADVISORY SYSTEM BASED ON CORRELATION MODEL AND WINDOWED PRINCIPAL COMPONENT ANALYSIS

(75) Inventors: Jingbo Wang, New York, NY (US); Krishnan Kumaran, Raritan, NJ (US); Peng Xu, Annandale, NJ (US); Steven F. Sowers, South Yarra (AU); Lei Wang, Sugar Land, TX (US); Jeffrey R. Bailey, Houston, TX (US); Erika A. O. Biediger, Houston, TX (US); Vishwas Gupta, Sugar Land, TX (US); Narasimha-Rao V. Bangaru, Pittstown, NJ (US); Swarupa S. Bangaru, legal representative, Pittstown, NJ (US)

(73) Assignee: ExxonMobil Upstream Research Company, Spring, TX (US)

( * ) Notice: Subject to any disclaimer, the term of this patent is extended or adjusted under 35 U.S.C. 154(b) by 409 days.

(21) Appl. No.: 13/386,610

(22) PCT Filed: Jun. 28, 2010

(86) PCT No.: PCT/US2010/040201

§ 371 (c)(1),
(2), (4) Date: Jan. 23, 2012

(87) PCT Pub. No.: WO2011/016928

PCT Pub. Date: Feb. 10, 2011

(65) Prior Publication Data

US 2012/0123756 A1 May 17, 2012

Related U.S. Application Data

(60) Provisional application No. 61/232,274, filed on Aug. 7, 2009.

(51) Int. Cl.
*G06F 17/50* (2006.01)
*E21B 44/00* (2006.01)

(52) U.S. Cl.
CPC ..... *E21B 44/00* (2013.01)

(58) Field of Classification Search
CPC .... G01V 11/00; G01V 2210/612; G01V 3/32; G01V 1/28; G01V 1/282;
(Continued)

(56) References Cited

U.S. PATENT DOCUMENTS 4,507,735 A 3/1985 Moorehead et al.
4,736,297 A 4/1988 LeJeune
(Continued)

FOREIGN PATENT DOCUMENTS

CA 2009654 * 2/1991 ..... G06F 15/20

OTHER PUBLICATIONS

Ciampi, A., Lechevallier, Y., (Statistical Models and Artificial Neural Networks: Supervised Classification and Prediction Via Soft Trees, Statistics for Industry and Technology: Advances in Statistical Methods for Health Sciences, Birkhauser, Boston, 2007 p. 243-265.).*

(Continued)

*Primary Examiner* — Aniss Chad
*Assistant Examiner* — Brian S. Cook
(74) *Attorney, Agent, or Firm* — ExxonMobil Upstream Research Company—Law Department

(57) ABSTRACT

Methods and systems for controlling drilling operations include using a statistical model to identify at least two controllable drilling parameters having significant correlation to one or more drilling performance measurements. The methods and systems further generate operational recommendations for at least two controllable drilling parameters based at least in part on the statistical model. The operational recommendations are selected to optimize one or more drilling performance measurements.

32 Claims, 15 Drawing Sheets

(58) Field of Classification Search
CPC ..... G01V 1/288; G01V 1/306; G01V 1/40; G01V 1/44; G01V 2210/6163; G01V 2210/6167; G01V 5/12; C04B 41/4933; C04B 41/463; C04B 41/00; E21B 44/00
USPC ..... 703/2, 10; 175/25, 39, 40; 324/303; 702/11, 14, 2, 6, 9, 8; 356/436
See application file for complete search history.

(56) References Cited

U.S. PATENT DOCUMENTS

| | | | | |
|---|---|---|---|---|
| 5,551,286 | A | 9/1996 | Booer | |
| 5,730,234 | A | 3/1998 | Putot | |
| 5,842,149 | A | 11/1998 | Harrell et al. | |
| 6,026,912 | A | 2/2000 | King et al. | |
| 6,155,357 | A | 12/2000 | King et al. | |
| 6,192,998 | B1 | 2/2001 | Pinckard | |
| 6,293,356 | B1 | 9/2001 | King et al. | |
| 6,382,331 | B1 * | 5/2002 | Pinckard | E21B 44/00 175/27 |
| 6,408,953 | B1 | 6/2002 | Goldman et al. | |
| 6,424,919 | B1 | 7/2002 | Moran et al. | |
| 6,443,242 | B1 | 9/2002 | Newman et al. | |
| 6,480,118 | B1 | 11/2002 | Rao | |
| 6,662,110 | B1 | 12/2003 | Bargach et al. | |
| 6,732,052 | B2 | 5/2004 | Macdonald et al. | |
| 6,820,702 | B2 | 11/2004 | Niedermayr et al. | |
| 6,892,812 | B2 | 5/2005 | Niedermayr et al. | |
| 6,968,909 | B2 | 11/2005 | Aldred et al. | |
| 7,020,597 | B2 | 3/2006 | Oliver et al. | |
| 7,044,238 | B2 | 5/2006 | Hutchinson | |
| 7,044,239 | B2 | 5/2006 | Pinckard et al. | |
| 7,142,986 | B2 | 11/2006 | Moran | |
| 7,172,037 | B2 * | 2/2007 | Dashevskiy et al. | 175/25 |
| 7,261,167 | B2 | 8/2007 | Goldman et al. | |
| 7,316,278 | B2 | 1/2008 | Hutchinson | |
| 7,357,196 | B2 | 4/2008 | Goldman et al. | |
| 7,363,988 | B2 * | 4/2008 | Jeffryes | 175/40 |
| 7,606,666 | B2 | 10/2009 | Repin et al. | |
| 7,610,251 | B2 | 10/2009 | Shayegi et al. | |
| 7,857,047 | B2 | 12/2010 | Remmert et al. | |
| 7,878,268 | B2 | 2/2011 | Chapman et al. | |
| 7,896,105 | B2 | 3/2011 | Dupriest | |
| 8,014,987 | B2 | 9/2011 | Pabon et al. | |
| 2002/0104685 | A1 | 8/2002 | Pinckard et al. | |
| 2005/0096847 | A1 | 5/2005 | Huang | |
| 2005/0099618 | A1 * | 5/2005 | DiFoggio et al. | 356/70 |
| 2005/0197777 | A1 | 9/2005 | Rodney et al. | |
| 2006/0139646 | A1 * | 6/2006 | DiFoggio | 356/436 |
| 2006/0151214 | A1 * | 7/2006 | Prange et al. | 175/45 |
| 2006/0155470 | A1 * | 7/2006 | Voutay et al. | 702/2 |
| 2007/0013911 | A1 * | 1/2007 | DiFoggio | 356/436 |
| 2008/0156531 | A1 * | 7/2008 | Boone | E21B 7/06 175/27 |
| 2008/0183390 | A1 * | 7/2008 | Hamdan et al. | 702/11 |
| 2009/0044938 | A1 * | 2/2009 | Crossley et al. | 166/250.15 |
| 2009/0076873 | A1 * | 3/2009 | Johnson et al. | 705/8 |
| 2009/0089227 | A1 | 4/2009 | Sturrock et al. | |
| 2009/0090555 | A1 | 4/2009 | Boone et al. | |
| 2009/0093963 | A1 * | 4/2009 | Rasolofosaon et al. | 702/14 |
| 2009/0132458 | A1 | 5/2009 | Edwards et al. | |
| 2009/0164182 | A1 * | 6/2009 | Pedersen et al. | 703/2 |
| 2009/0174402 | A1 * | 7/2009 | Rottengatter et al. | 324/303 |
| 2009/0299636 | A1 | 12/2009 | Carnegie et al. | |
| 2010/0108384 | A1 | 5/2010 | Byreddy et al. | |

OTHER PUBLICATIONS

Kattan, M., Statistical Prediction Models, Artificial Neural Networks, and the Sophism "I Am a Patient, Not a Statistic", Journal of Clinical Oncology, vol. 20, No. 4 Feb. 15, 2002: pp. 885-887.*
Resop, J.P., A Comparison of Artificial Neural Networks and Statistical Regression with Biological Resources Applications, University of Maryland, College Part, 2006.*
Abarca-Hernandez F., Chica-Olmo, M., Evaluation of Geostatistical Measures of Radiometric Spatial Variabilit for Lithologic Discrimination in Ladnsat TM Images, Photogrammetric Engineering & Remote Sensing, vol. 65, No. 6, Jun. 1999, pp. 705-711.*
Kenea, N.H., Haenisch, H., Principal Component Analysis for Lithogic and Alteration Mappins: Examples from the Red Sea Hills, Sudan, International Archives of Photogrammetry and Remote Sensing. vol. XXXI, Part B7. Vienna 1996.*
Chica-Olmo, M., Abarca-Hernandez, F., Computing geostatistical image texture for remotely sensed data classification, Computers & Geosciences 26 (2000) 373-383 • Hagen, D.C., The Application of Principal Components Analysis to Seismic Data Sets, Geoexploration, 20 (1982) 93-111.*
Wang, X., Kruger, U., Irwin, G.W., Process Monitoring Approach Using Fast Moving Window PCA, Ind. Eng. Chem. Res. 2005, 44, 5691-5702.*
Wold, S. et al., "Principal Component Analysis", Chemometrics and I ntelligent Laboratory Systems, 1987, 2, pp. 37-52.*
Hagen, D.C., The Application of Principal Components Analysis to Seismic Data Sets, Geoexploration, 20 (1982) 93-111.*
(Artificial neural network) Wikipedia, Aug. 5, 2009, downloaded on Aug. 12, 2014 from http://en.wikipedia.org/w/index.php?title=Artificial_neural_network&oldid=306118106.*
Greenberg, J., Varel bit design enhances hydraulic flow to improve ROP in Barnett Shale lateral drilling, Drilling Rig Equipment, Sep./Oct. 2007.*
Baumert, M.E., Drilling Fluid Considerations in Design of Engineered Horizontal Directional Drilling Installations, International journal of Geomechanics ASCE/Dec. 2005.*
Zhu, X., Critical weight on bit of double-driven bottomhole assembly during vertical and fast drilling, Central South University Press and Spring-Verlag Berlin Heidelberg 2012.*
Kreuzer, E. Analysis of long torsional string by proper orthogonal decomposition, Archive of Appliced Mechanics 67 (1996) 68-80 Springer-Verlag 1996.*
Mastinu, G., Optimal Design of Complex Mechanical Systems, ISBN-10 3-540-34354-7 Springer Berlin Heidelberg New York, 2006.*
Principle Component Analysis Defined, Archive dated Aug. 3, 2009 https://en.wikipedia.org/w/index.php?title=Principal_component_analysis&oldid=3058003 . . . .*
Savic, D., Single-objective vs. Multiobjective Optimisation for Integrated Decision Support, In: Integrated Assessment and Decision (2002) Venue: Proceedings of the First Biennial Meeting of the International Environmental Modelling and Software Society.*
Negative Relationship Defined Sep. 9, 2008 https://en.wikipedia.org/w/index.php?title=Negative_relationship&oldid=237385225.*
Pareto Efficiency Defined Jul. 2009 https://en.wikipedia.org/w/index.php?title=Pareto_efficiency&oldid=304926205.*
Biblawi_2007.pdf Some drilling parameters as a tool to predict different categories of rocks, Journal of Engineering Sciences, Assiut University, vol. 35, No. 4, pp. 995-1088, Jul. 2007.*
SPE_March_2009.pdf SPE/IADC 119826 Performance Drilling—Definition, Benchmarking, Performance Qualifiers, Efficiency and Value, SPE/IADC Proceedings Amsterdam, The Netherlands Mar. 17-19, 2009 vol. 1 of 2, ISBN: 978-1-61567-009-3, Printed by Curran Associates, Inc. p. 1063.*
Teale_1965.pdf The Concept of Specific Energy in Rock Drilling, Int. J. Rock Mech. Mining Sci. vol. 2, pp. 57-73. Pergamon Press 1965.*
Dupriest_2005.pdf Maximizing Drill Rates with Real-Time Surveillance of Mechanical Specific Energy, SPE/IADC 92194, Feb. 2005.*
Boyd, S. et al., *Convex Optimization*, Cambridge University Press, Mar. 8, 2004, pp. 146-160.
Dupriest, F.E. et al., "Maximizing Drill Rates with Real-Time Surveillance of Mechanical Specific Energy", SPE/IADC 92194, Feb. 23-25, 2005, SPE/IADC Drilling Conference, Amsterdam, The Netherlands, 10 pgs.
Fruhwirth, R.K. et al., "Hybrid Simulation Using Neural Networks to Predict Drilling Hydraulics in Real Time", SPE 103217, 2006 SPE Annual Technical Conference, Sep. 24-27, 2006, San Antonio, TX, 8 pgs.

(56) References Cited

OTHER PUBLICATIONS

Hastie, T. et al., *The Elements of Statistical Learning: Data Mining, Inference, and Prediction*, 2001, Springer-Verlag, pp. 501-508.
Jain, A.K. et al., "Data Clustering: A Review", *ACM Computing Surveys* Sep. 1999, 31(3), pp. 265-317.
Jolliffe, I.T., *Springer Series in Statistics, Principal Component Analysis*,2002 , Springer-Verlag New York Inc., pp. 63-77.
Skalle, P. et al., "Improved Efficiency of Oil Well Drilling through Case Based Reasoning", Proceedings of PRICAL 2000, Springer-Verlag, pp. 712-722.
Skalle, P. et al.), "Knowledge-Based Decision Support in Oil Well Drilling", *Intelligent Information Processing II*, 2004, pp. 443-455, London.
Tan, P.N. et al., "Cluster Analysis: Additional Issues and Algorithms", May 2005, Pearson, Addison & Wesley, pp. 569-576.
Teale, R., "The Concept of Specific Energy in Rock Drilling", Int. J. Rock Mech. Mining Sci & Geomech, 1965, Abstract 2, pp. 57-73.
Wang, X. et al., "Process Monitoring Approach Using Fast Moving Window PCA", Ind. Eng. Chem. Res., 2005, 44, pp. 5691-5702.
Wold, S. et al., "Principal Component Analysis", Chemometrics and Intelligent Laboratory Systems, 1987, 2, pp. 37-52.

* cited by examiner

AUTOMATIC DRILLING ADVISORY SYSTEM BASED ON CORRELATION MODEL AND WINDOWED PRINCIPAL COMPONENT ANALYSIS

CROSS REFERENCE TO RELATED APPLICATIONS

This application is the National Stage of International Application No. PCT/US10/40201, filed 28 Jun. 2010, which claims the benefit of U.S. Provisional Application No. 61/232,274, filed 7 Aug. 2009.

FIELD

The present disclosure relates generally to systems and methods for improving drilling operations. More particularly, the present disclosure relates to systems and methods that may be implemented in cooperation with hydrocarbon-related drilling operations to improve drilling performance.

BACKGROUND

This section is intended to introduce the reader to various aspects of art, which may be associated with embodiments of the present invention. This discussion is believed to be helpful in providing the reader with information to facilitate a better understanding of particular techniques of the present invention. Accordingly, it should be understood that these statements are to be read in this light, and not necessarily as admissions of prior art.

The oil and gas industry incurs substantial operating costs to drill wells in the exploration and development of hydrocarbon resources. The cost of drilling wells may be considered to be a function of time due to the equipment and manpower expenses being based on time. The drilling time can be minimized in at least two ways: 1) maximizing the Rate-of-Penetration (ROP) (i.e., the rate at which a drill bit penetrates the earth); and 2) minimizing the non-drilling rig time (e.g., time spent tripping equipment to replace or repair equipment, constructing the well during drilling, such as to install casing, and/or performing other treatments on the well). Past efforts have attempted to address each of these approaches. For example, drilling equipment is constantly evolving to improve both the longevity of the equipment and the effectiveness of the equipment at promoting a higher ROP. Moreover, various efforts have been made to model and/or control drilling operations to avoid equipment-damaging and/or ROP limiting conditions, such as vibrations, bit-balling, etc.

Many attempts to reduce the costs of drilling operations have focused on increasing the ROP. For example, U.S. Pat. Nos. 6,026,912; 6,293,356; and 6,382,331 each provide models and equations for use in increasing the ROP. In the methods disclosed in these patents, the operator collects data regarding a drilling operation and identifies a single control variable that can be varied to increase the rate of penetration. In most examples, the control variable is Weight On Bit (WOB); the relationship between WOB and ROP is modeled; and the WOB is varied to increase the ROP. While these methods may result in an increased ROP at a given point in time, this specific parametric change may not be in the best interest of the overall drilling performance in all circumstances. For example, bit failure and/or other mechanical problems may result from the increased WOB and/or ROP. While an increased ROP can drill further faster during the active drilling, delays introduced by damaged equipment and equipment trips required to replace and/or repair the equipment can lead to a significantly slower overall drilling performance. Furthermore, other parametric changes, such as a change in the rate of rotation of the drillstring (RPM), may be more advantageous and lead to better drilling performance than simply optimizing along a single variable.

Because drilling performance is measured by more than just the instantaneous rate of penetration, methods such as those discussed in the above-mentioned patents are inherently limited. Other research has shown that drilling rates can be improved by considering the Mechanical Specific Energy of the drilling operation and designing a drilling operation that will minimize the Mechanical Specific Energy (MSE). For example, U.S. Patent Publication No. US2008-0105424 and International Publication No. WO2007/073430, each of which is incorporated herein by reference in their entirety for all purposes, disclose methods of calculating and/or monitoring MSE for use in efforts to increase rate of penetration. Specifically, the MSE of the drilling operation over time is used to identify the drilling condition limiting the rate of penetration, often referred to as the founder limiter. Once the founder limiter has been identified, one or more drilling variables can be changed to overcome the founder limiter and increase the ROP. As one example, the MSE pattern may indicate that bit-balling is limiting the ROP. Various measures may be taken to clear the cuttings from the bit and improve the ROP, either during the ongoing drilling operation or by tripping and changing equipment.

Recently, additional interest has been generated in utilizing artificial neural networks to optimize the drilling operations, for example U.S. Pat. No. 6,732,052 B2, U.S. Pat. No. 7,142,986 B2, and U.S. Pat. No. 7,172,037 B2. However the limitations of neural network based approaches constrain their further applications. For instance, the result accuracy is sensitive to the quality of the training dataset and network structures, the optimization is based on local searches and that it may be difficult to process new or highly variable patterns.

In another example, U.S. Pat. No. 5,842,149 disclosed a close-loop drilling system intended to automatically adjust drilling parameters. However, this system requires a look-up table to provide the relations between ROP and drilling parameters. Therefore, the optimization results depended on the effectiveness of this table and the methods used to generate this data, and consequently, the system may lack adaptability to new drilling conditions which were not included in the table. Another limitation is that downhole data is required to perform the optimization.

While these past approaches have provided some improvements to drilling operations, further advances and more adaptable approaches are still needed as hydrocarbon resources are pursued in reservoirs that are harder to reach and as drilling costs continue to increase. Further desired improvements may include expanding the optimization efforts from increasing the ROP to optimizing the drilling performance measured by a combination of factors, such as ROP, efficiency, downtime, etc. Additional improvements may include expanding the optimization efforts from iterative control of a single control variable to control of multiple control variables. Moreover, improvements may include developing systems and methods capable of recommending operational changes during ongoing drilling operations.

While such research objectives can be readily appreciated when considered in this light, there are several challenges in achieving any one of these goals. For example, improved systems and methods should be able to correctly model dynamics between changes in drilling variables and the consequences in ROP and/or MSE (or other measurable parameter of drilling performance). Improved systems and methods may additionally or alternatively be adapted to identify efficient and safe zones of operations in light of the multitude of variables that can affect the drilling performance, only some of which are controllable and/or measurable. Additionally or alternatively, improved systems and methods may be adaptive to react to changes in drilling conditions in real time, such as responding to lithology changes or other uncontrollable changes in drilling conditions. When an abnormal drilling event happens, improved systems and methods may be able to detect it at its emergence and generate recommendations to mitigate the problem. Accordingly, the need exists for systems or methods to improve drilling performance measured by factors more robust and indicative than just the rate of penetration. Additionally or alternatively, the need exists for systems or methods for improving drilling performance by controlling at least two controllable drilling variables. In some implementations, recommendations for the control of such controllable drilling variables may be generated and/or implemented in at least substantially real-time during ongoing drilling operations. The present invention provides systems and methods to provide one or more of these improvements and/or to satisfy one or more of these needs.

SUMMARY

The present methods are directed to methods and systems for use in drilling a wellbore, such as wellbore used in hydrocarbon production related operations. An exemplary method includes: 1) receiving data regarding drilling parameters characterizing ongoing wellbore drilling operations, wherein at least two of the drilling parameters are controllable; 2) utilizing a statistical model to identify at least two controllable drilling parameters having significant correlation to one or more drilling performance measurements; 3) generating operational recommendations for at least two controllable drilling parameters, wherein the operational recommendations are selected to optimize one or more drilling performance measurements; 4) determining operational updates to at least one controllable drilling parameter based at least in part on the generated operational recommendations; and 5) implementing at least one of the determined operational updates in the ongoing drilling operations.

The present disclosure is further directed to computer-based systems for use in association with drilling operations. Exemplary computer-based systems may include: 1) a processor adapted to execute instructions; 2) a storage medium in communication with the processor; and 3) at least one instruction set accessible by the processor and saved in the storage medium. The at least one instruction set is adapted to perform the methods described herein. For example, the instruction set may be adapted to 1) receive data regarding drilling parameters characterizing ongoing wellbore drilling operations, wherein at least two of the drilling parameters are controllable; 2) utilize a statistical model to identify at least two controllable drilling parameters having significant correlation to one or more drilling performance measurements; 3) generate operational recommendations for the at least two controllable drilling parameters, wherein the recommendations are selected to optimize one or more drilling performance measurements; and 4) export the generated operational recommendations for consideration in controlling ongoing drilling operations.

The present disclosure is also directed to drilling rigs and other drilling equipment adapted to perform the methods described herein. For example, the present disclosure is directed to a drilling rig system comprising: 1) a communication system adapted to receive data regarding at least two drilling parameters relevant to ongoing wellbore drilling operations; 2) a computer-based system according to the description herein, such as one adapted to perform the methods described herein; and 3) an output system adapted to communicate the generated operational recommendations for consideration in controlling drilling operations. The drilling equipment may further include a control system adapted to determine operational updates based at least in part on the generated operational recommendations and to implement at least one of the determined operational updates during the drilling operation. The control system may be adapted to implement at least one of the determined operational updates at least substantially automatically.

BRIEF DESCRIPTION OF THE DRAWINGS

The foregoing and other advantages of the present technique may become apparent upon reading the following detailed description and upon reference to the drawings in which.

DETAILED DESCRIPTION

In the following detailed description, specific aspects and features of the present invention are described in connection with several embodiments. However, to the extent that the following description is specific to a particular embodiment or a particular use of the present techniques, it is intended to be illustrative only and merely provides a concise description of exemplary embodiments. Moreover, in the event that a particular aspect or feature is described in connection with a particular embodiment, such aspects and features may be found and/or implemented with other embodiments of the present invention where appropriate. Accordingly, the invention is not limited to the specific embodiments described below. But rather, the invention includes all alternatives, modifications, and equivalents falling within the scope of the appended claims.

Figure 1:
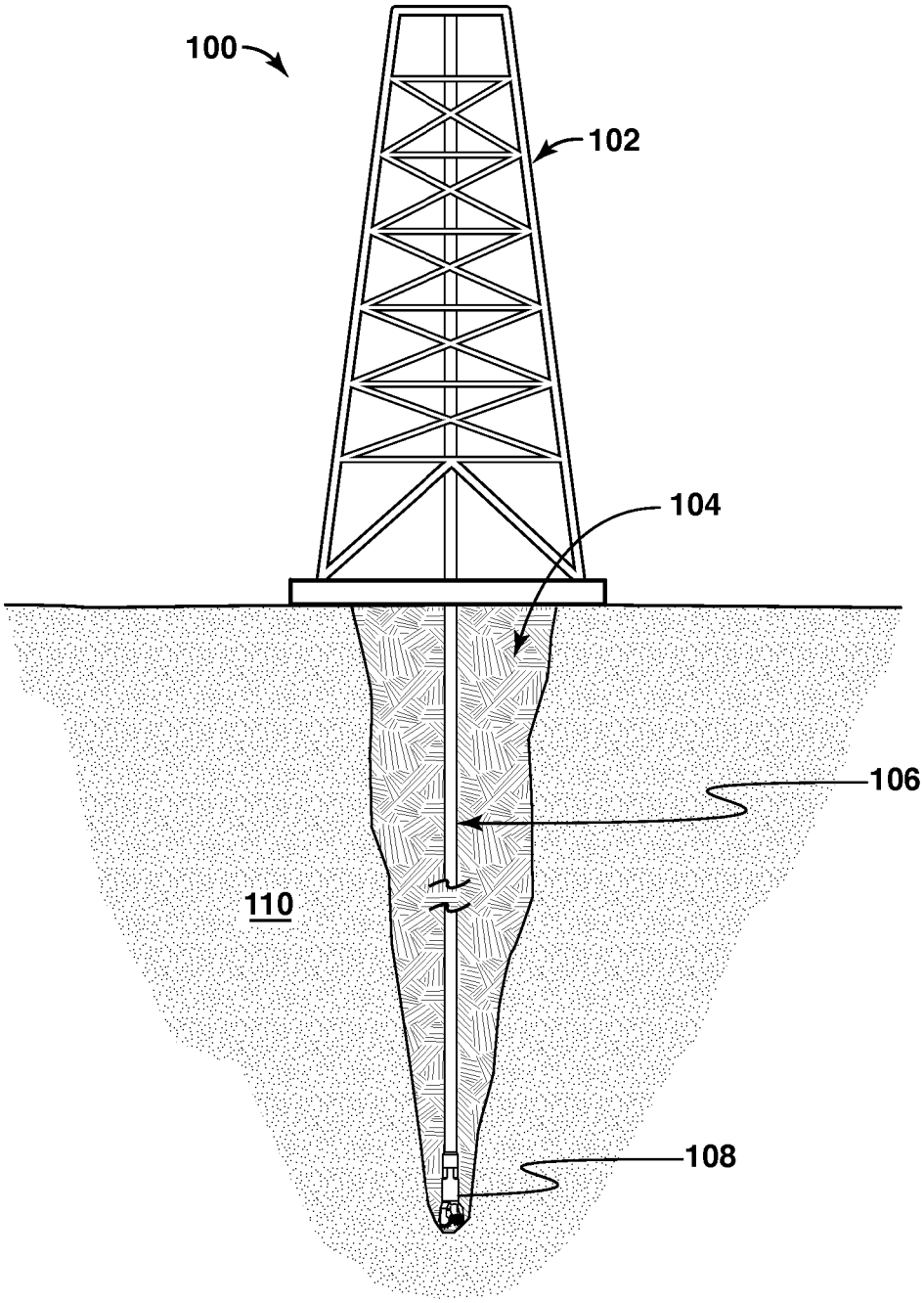
FIG. 1 is schematic view of a well showing the environment in which the present systems and methods may be implemented.

FIG. 1 illustrates a side view of a relatively generic drilling operation at a drill site 100. FIG. 1 is provided primarily to illustrate the context in which the present systems and methods may be used. As illustrated, the drill site 100 is a land based drill site having a drilling rig 102 disposed above a well 104. The drilling rig 102 includes a drillstring 106 including a drill bit 108 disposed at the end thereof. The apparatus illustrated in FIG. 1 are shown in almost schematic form to show the representative nature thereof. The present systems and methods may be used in connection with any currently available drilling equipment and is expected to be usable with any future developed drilling equipment. Similarly, the present systems and methods are not limited to land based drilling sites but may be used in connection with offshore, deepwater, arctic, and the other various environments in which drilling operations are conducted.

While the present systems and methods may be used in connection with any drilling operation, they are expected to be used primarily in drilling operations related to the recovery of hydrocarbons, such as oil and gas. Additionally, it is noted here that references to drilling operations are intended to be understood expansively. Operators are able to remove rock from a formation using a variety of apparatus and methods, some of which are different from conventional forward drilling into virgin formation. For example, reaming operations, in a variety of implementations, also remove rock from the formation. Accordingly, the discussion herein referring to drilling parameters, drilling performance measurements, etc., refers to parameters, measurements, and performance during any of the variety of operations that cut rock away from the formation. As is well known in the drilling industry, a number of factors affect the efficiency of the drilling operations, including factors within the operators' control and factors that are beyond the operators' control. For the purposes of this application, the term drilling conditions will be used to refer generally to the conditions in the wellbore during the drilling operation. The drilling conditions are comprised of a variety of drilling parameters, some of which relate to the environment of the wellbore and/or formation and others that relate to the drilling activity itself. For example, drilling parameters may include rate of rotation, weight on bit, characteristics of the drill bit and drillstring, mud weight, mud flow rate, lithology of the formation, pore pressure of the formation, torque, pressure, temperature, rate of penetration, mechanical specific energy, vibration measurements etc. As can be understood from the listing above, some of the drilling parameters are controllable and others are not. Similarly, some may be directly measured and others must be calculated based on one or more other measured parameters.

As drilling operations progress, the drill bit 108 advances through the formation 110 at a rate known as the rate of penetration (108), which is commonly calculated as the measured depth drilled over time. As the formation conditions are location dependent, the drilling conditions necessarily change over time. Moreover, the drilling conditions may change in manners that dramatically reduce the efficiencies of the drilling operation and/or that create less preferred operating conditions. Accordingly, research is continually seeking improved methods of predicting and detecting changes in drilling conditions. As described in the Background above, the past research has focused on monitoring a measure of drilling efficiency, the rate of penetration, and seeking to change drilling parameters to increase the rate of penetration. Such efforts have embodied two paradigms: 1) iteratively changing a single controllable drilling parameter, typically the weight on bit, while monitoring the rate of penetration until a maximum rate of penetration is obtained; and 2) monitoring the mechanical specific energy of a drilling operation to characterize one or more drilling events (founder limiters) that are limiting the rate of penetration and determining a change in the drilling parameters that will overcome the founder limiter. The present systems and methods provide at least one improvement over these paradigms.

Figure 2:
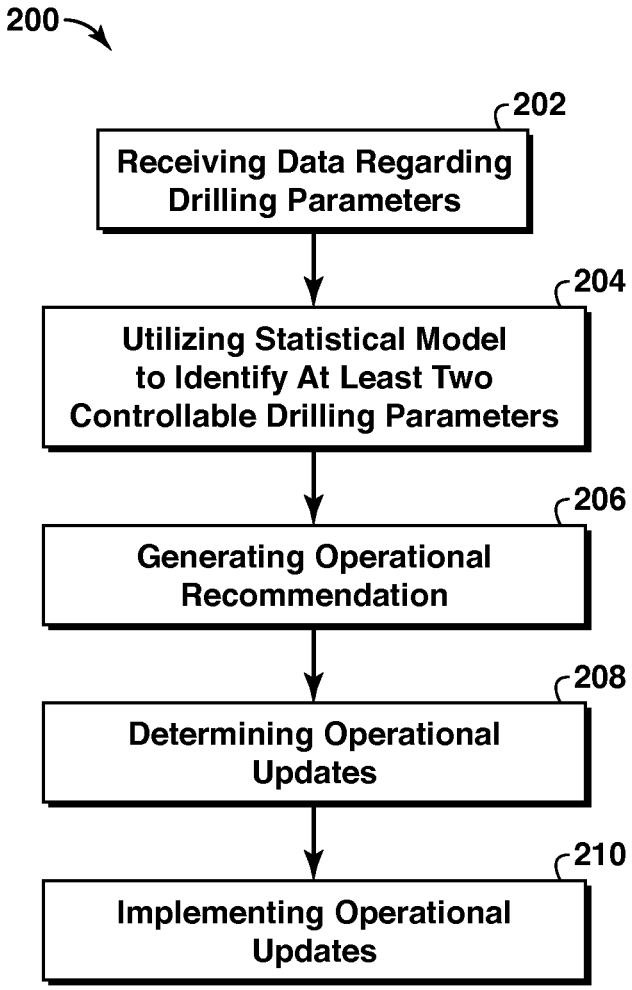
FIG. 2 is a flow chart of methods for updating operational parameters to optimize drilling operations.

As illustrated in FIG. 2, the present invention includes methods of drilling a wellbore 200. FIG. 2 provides an overview of the methods disclosed herein, which will be expanded upon below. In its most simple explanation, the present methods of drilling include: 1) receiving data regarding ongoing drilling operations, specifically data regarding drilling parameters that characterize the drilling operations, at 202; 2) utilizing a statistical model to identify at least two controllable drilling parameters having significant correlation to drilling performance, at 204; 3) generating operational recommendations to optimize drilling performance, at 206; 4) determining operational updates, at 208; and 5) implementing the operational updates, at 210.

The step 202 of receiving data regarding ongoing drilling operations includes receiving data regarding drilling parameters that characterize the ongoing drilling operations. At least two of the drilling parameters received are controllable drilling parameters, such as rotation rate, weight on bit, mud flow rate, etc. The data may be received in any suitable manner using equipment that is currently available or future developed technology. Similarly, the data regarding drilling parameters may come from any suitable source. For example, data regarding some drilling parameters may be appropriately collected from surface instruments while other data may be more appropriately collected from downhole measurement devices. As one more specific example, data may be received regarding the drill bit rotation rate, an exemplary drilling parameter, either from the surface equipment or from downhole equipment, or from both surface and downhole equipment. The surface equipment may either provide the controlled rotation rate provided as an input to the drilling equipment or a measurement of the actual bit rate downhole. The downhole bit rotation rate can also be measured and/or calculated using one or more downhole tools. Any suitable technology may be used in cooperation with the present systems and methods to provide data regarding any suitable assortment of drilling parameters, provided that the drilling parameters are related to and can be used to characterize ongoing drilling operations and provided that at least two of the drilling parameters are directly or indirectly controllable by an operator.

As indicated above, the methods include, at 204, utilizing a statistical model to identify at least two controllable drilling parameters having significant correlation to one or more drilling performance measurements, such as ROP, MSE, vibration measurements, etc., and mathematical combinations thereof. In some implementations, two or more statistical models may be used in cooperation, synchronously, iteratively, or in other arrangements to identify the significantly correlated and controllable drilling parameters. In some implementations, the statistical model may be utilized in substantially real-time utilizing the received data. Exemplary statistical models are described in further detail below.

In general terms, the statistical model relates two or more drilling parameters to one or more drilling performance measurements and determines the degree of correlation between the performance measurements and the drilling parameters. By way of non-limiting example, the rate of penetration (ROP) may be modeled as a function of weight on bit, rotation rate, hydraulic horsepower (e.g., mud flow rate, viscosity, pressure, etc.), etc., and combinations thereof. Additionally or alternatively, an objective function may be used to relate one or more drilling parameters to one or more drilling performance measurements. Additional details and examples of utilizing statistical methods to identify correlated drilling parameters are provided below.

With continuing reference to FIG. 2, the step of generating operational recommendations at 206 includes generating recommendations for at least two controllable drilling parameters. The operational recommendations generated are selected to optimize one or more drilling performance measurements. In some implementations, the recommendations may provide qualitative recommendations, such as increase, decrease, or maintain a given drilling parameter (e.g., weight on bit, rotation rate, etc.). Additionally or alternatively, the recommendations may provide quantitative recommendations, such as to increase a drilling parameter by a particular measure or percentage or to decrease a drilling parameter to a particular value or range of values. The generation of operational recommendations may be a product of the statistical methods and/or may utilize inputs in addition to the output of the statistical methods. In some implementations, the statistical methods may generate operational recommendations as part of the identification of correlated drilling parameters, such as identifying the correlated parameters and the manner in which they should be adjusted or updated to optimize the drilling performance measurement or objective function. Furthermore, in some implementations, the operational recommendations may be subject to boundary limits, such as maximum rate of rotation, minimum acceptable mud flow rate, top-drive torque limits, etc., that represent either physical equipment limits or limits derived by consideration of other operational aspects of the drilling process. For example, there may be a minimum acceptable mud flow rate to transport drill cuttings to the surface and/or a maximum acceptable rate above which the equivalent circulating density becomes too high.

Continuing with the discussion of FIG. 2, the step of determining operational updates, at 208, includes determining operational updates to at least one controllable drilling parameter, which determined operational updates are based at least in part on the generated operational recommendations. Similar to the generation of operational recommendations and as will be discussed in greater detail below, the determined operational update for a given drilling parameter may include directional updates and/or quantified updates. For example, the determined operational update for a given drilling parameter may be selected from increase/decrease/maintain commands or may quantify the degree to which the drilling parameter should be changed, such as increasing or decreasing the weight on bit by X and increasing or decreasing the rotation rate by Y.

The step of determining operational updates may be performed by one or more of operators (i.e., individuals at the rig site or in communication with the drilling equipment) and computer-based systems. For example, drilling equipment is being more and more automated and some implementations may be adapted to consider the operational recommendations alone or together with other data or information and determine operational updates to one or more drilling parameters. Additionally or alternatively, the drilling equipment and computer-based systems associated with the present methods may be adapted to present the operational recommendations to a user, such as an operator, who determines the operational updates based at least in part on the operational recommendations. The user may determine the operational updates based at least in part on the operational recommendations using "hog laws" or other experienced based methods and/or by using computer-based systems.

Finally, the step of implementing at least one of the determined operational updates in the ongoing drilling operation, at 210, may include modifying and/or maintaining at least one aspect of the ongoing drilling operations based at least in part on the determined operational updates. In some implementations, such as when the operational updates are determined by computer-based systems from the operational recommendations, the implementation of the operational updates may be automated to occur without user intervention or approval. Additionally or alternatively, the operational updates determined by a computer-based system may be presented to a user for consideration and approval before implementation. For example, the user may be presented with a visual display of the proposed determined operational updates, which the user can accept in whole or in part without substantial steps between the presentation and the implementation. For example, the proposed updates may be presented with 'accept' and 'change' command buttons or controls and with 'accept all' functionality. In such implementations, the implementation of the determined operational updates may be understood to be substantially automatic as the user is not required to perform calculations or modelings to determine the operational update or to perform several manual steps to effect the implementation. Additionally or alternatively, the implementation of the determined operational updates may be effected by a user after a user or other operator has considered the operational recommendations and determined operational updates.

While specific examples of implementations within the scope of the above described method and within the scope of the claims are described below, it is believed that the description provided above and in connection with FIG. 2 illustrates at least one improvement over the paradigms of the previous efforts. Specifically, and as indicated above, the present methods and systems are capable of generating operational recommendations for at least two controllable drilling parameters simultaneously rather than iteratively.

The statistical modeling utilized to identify the at least two significantly correlated controllable drilling parameters and the use of drilling performance measurements functionally related to the controllable drilling parameters facilitate the generation of such recommendations. Specific examples of suitable relationships and statistical models are provided below for enhanced understanding of the present systems and methods. However, it should be understood that other relationships and/or modeling techniques may be used in implementations of the above-described methods.

Figure 3:
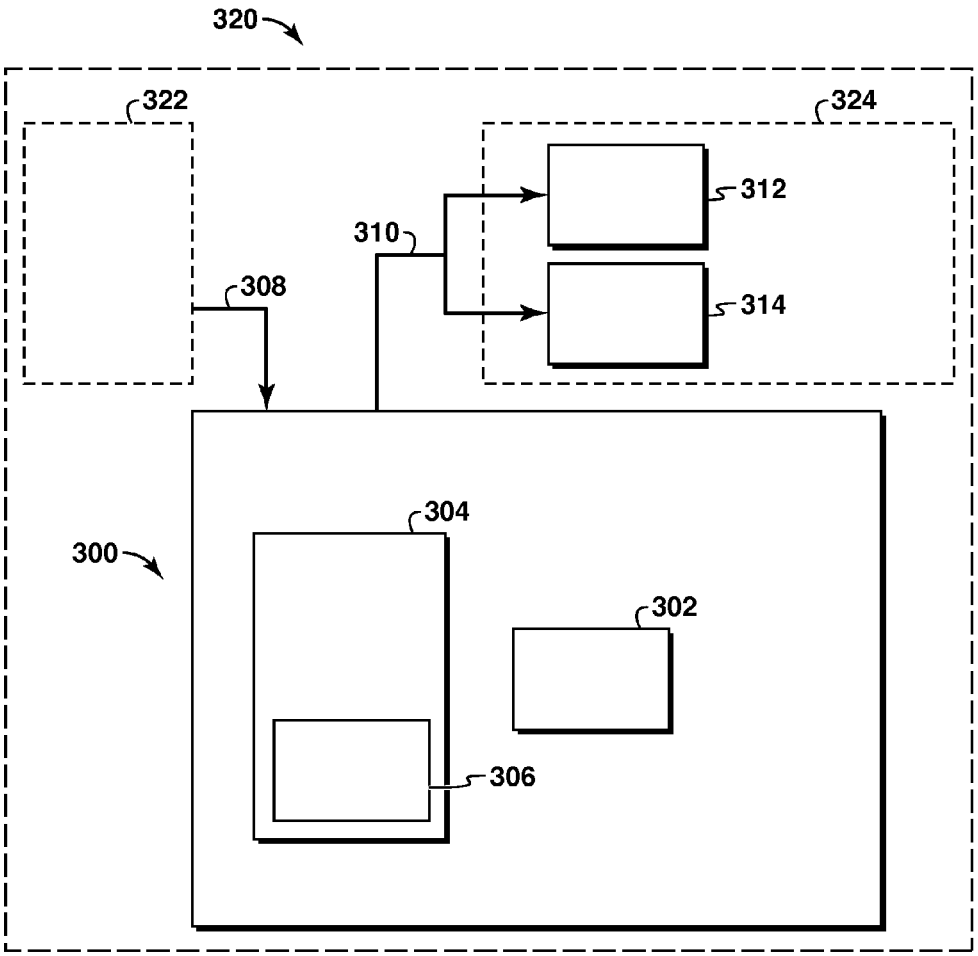
FIG. 3 is a schematic view of systems within the scope of the present invention.

FIG. 3 schematically illustrates systems within the scope of the present invention. In some implementations, the systems comprise a computer-based system 300 for use in association with drilling operations. The computer-based system may be a computer system, may be a network-based computing system, and/or may be a computer integrated into equipment at the drilling site. The computer-based system 300 comprises a processor 302, a storage medium 304, and at least one instruction set 306. The processor 302 is adapted to execute instructions and may include one or more processor now known or future developed that is commonly used in computing systems. The storage medium 304 is adapted to communicate with the processor 302 and to store data and other information, including the at least one instruction set 306. The storage medium 304 may include various forms of electronic storage mediums, including one or more storage mediums in communication in any suitable manner. The selection of appropriate processor(s) and storage medium(s) and their relationship to each other may be dependent on the particular implementation. For example, some implementations may utilize multiple processors and an instruction set adapted to utilize the multiple processors so as to increase the speed of the computing steps. Additionally or alternatively, some implementations may be based on a sufficient quantity or diversity of data that multiple storage mediums are desired or storage mediums of particular configurations are desired. Still additionally or alternatively, one or more of the components of the computer-based system may be located remotely from the other components and be connected via any suitable electronic communications system. For example, some implementations of the present systems and methods may refer to historical data from other wells, which may be obtained in some implementations from a centralized server connected via networking technology. One of ordinary skill in the art will be able to select and configure the basic computing components to form the computer-based system.

Importantly, the computer-based system 300 of FIG. 3 is more than a processor 302 and a storage medium 304. The computer-based systems 300 of the present disclosure further include at least one instruction set 306 accessible by the processor and saved in the storage medium. The at least one instruction set 306 is adapted to perform the methods of FIG. 2 as described above and/or as described below. As illustrated, the computer-based system 300 receives data at data input 308 and exports data at data export 310. The at least one instruction set 306 is adapted to export the generated operational recommendations for consideration in controlling drilling operations. In some implementations, the generated operational recommendations may be exported to a display 312 for consideration by a user. In other implementations, the generated operational recommendations may be provided as an audible signal, such as up or down chimes of different characteristics to signal a recommended increase or decrease of WOB, RPM, or some other drilling parameter. In a modern drilling system, the driller is tasked with monitoring of onscreen indicators, and audible indicators, alone or in conjunction with visual representations, may be an effective method to convey the generated recommendations. The audible indicators may be provided in any suitable format, including chimes, bells, tones, verbalized commands, etc. Verbal commands, such as by computer generated voices, are readily implemented using modern technologies and may be an effective way of ensuring the right message is heard by the driller. Additionally or alternatively, the generated operational recommendations may be exported to a control system 314 adapted to determine at least one operational update. The control system 314 may be integrated into the computer-based system or may be a separate component. Additionally or alternatively, the control system 314 may be adapted to implement at least one of the determined updates during the drilling operation, automatically, substantially automatically, or upon user activation.

Continuing with the discussion of FIG. 3, some implementations of the present technologies may include drilling rig systems or components of the drilling rig system. For example, the present systems may include a drilling rig system 320 that includes the computer-based system 300 described herein. The drilling rig system 320 of the present disclosure may include a communication system 322 and an output system 324. The communication system 322 may be adapted to receive data regarding at least two drilling parameters relevant to ongoing drilling operations. The output system 324 may be adapted to communicate the generated operational recommendations and/or the determined operational updates for consideration in controlling drilling operations. The communication system 322 may receive data from other parts of an oil field, from the rig and/or wellbore, and/or from another networked data source, such as the Internet. The output system 324 may be adapted to include displays, printers, control systems 314, or other means of exporting the generated operational recommendations and/or the determined operational updates. In some implementations, the control system 314 may be adapted to implement at least one of the determined operational updates at least substantially automatically. As described above, the present methods and systems may be implemented in any variety of drilling operations. Accordingly, drilling rig systems adapted to implement the methods described herein to optimize drilling performance are within the scope of the present invention. For example, various steps of the presently disclosed methods may be done utilizing computer-based systems and algorithms and the results of the presently disclosed methods may be presented to a user for consideration via one or more visual displays, such as monitors, printers, etc, or via audible prompts, as described above. Accordingly, drilling equipment including or communicating with computer-based systems adapted to perform the presently described methods are within the scope of the present invention.

As described above in connection with FIG. 2, the present systems and methods are directed to optimization of one or more drilling performance measurements by determining relationships between two or more controllable drilling parameters and the one or more drilling performance measurements. In some implementations, the one or more drilling performance measurements may be embodied in one or more objective functions adapted to describe or model the performance measurement in terms of at least two controllable drilling parameters. In some implementations, the objective functions may be a characterization of the relationship between the rate of penetration and the two or more controllable drilling parameters. Additionally or alternatively, the objective functions may be a characterization of the relationship between the mechanical specific energy and the two or more controllable drilling parameters. Still additionally, the objective function may be a function of two or more drilling performance measurements (e.g., ROP and/or MSE) and/or may be a function of controllable and measurable parameters. Equations (1)-(3) provide specific examples of representative objective functions that may be utilized in the present systems and methods:

$$OBJ(MSE,ROP)=ROP, \tag{1}$$

$$OBJ(MSE, ROP) = \frac{\delta + ROP/ROP_o}{\delta + MSE/MSE_o}, \tag{2}$$

($\delta$ factor to be determined), and $$OBJ(MSE, ROP) = \frac{\delta + \Delta ROP/ROP}{\delta + \Delta MSE/MSE}. \tag{3}$$

($\delta$ factor to be determined)

The first objective function is to maximize ROP only, the second one is to maximize the ratio of ROP-to-MSE (simultaneously maximizing ROP and minimizing MSE), and the last one is to maximize the ROP percentage increase per unit percentage increase in MSE. These objective functions can be used for different scenarios depending on the specific objective of the drilling operation. Note that equation (1) is univariate and requires no normalizing, but equations (2) and (3) require a factor δ to avoid a singularity. Other formulations of the objective function OBJ(MSE,ROP) to avoid a possible divide-by-zero singularity may be devised within the scope of the invention (such as using δ only in the denominator). In equation (2), the nominal $ROP_0$ and $MSE_0$ are used to provide dimensionless values to account for varying formation drillability conditions. In equation (3), DROP and ΔMSE represent the changes of ROP and MSE respectively.

It is also important to point out that the methodology and algorithms presented in this invention are not limited to these three types of objective functions. They are applicable to and cover any form of objective function adapted to describe a relationship between drilling parameters and drilling performance measurement. For example, it is observed that MSE is sometimes not sensitive to downhole torsional vibrations such as stick-slip events which may generate large oscillations in the rotary speed of a drillstring. Basically, there are two approaches to take the downhole stick-slip into account. One is to display the stick-slip severity as a surveillance indicator but still use the MSE-based objective functions as shown in equations (2) or (3) to optimize the drilling performance. It is well-known that one means to mitigate stick-slip is to increase the surface RPM and/or reduce WOB. To optimize the objective function and reduce the stick-slip at the same time, the operational recommendation created from the model should be selected as the one that is compatible with the stick-slip mitigation. Another approach is to integrate the stick-slip severity (SS) into the objective functions, and equations (2)-(3) can be modified as $$OBJ(MSE, SS, ROP) = \frac{\delta + ROP/ROP_o}{\delta + MSE/MSE_o + SS/SS_o}, \tag{4}$$

($\delta$ factor to be determined), $$OBJ(MSE, SS, ROP) = \frac{\delta + \Delta ROP/ROP}{\delta + \Delta MSE/MSE + \Delta SS/SS}. \tag{5}$$

($\delta$ factor to be determined)

where nominal $SS_0$ is used to provide dimensionless values. The said stick-slip severity for both approaches can be either real-time stick-slip measurements transmitted from a downhole vibration measurement tool or a model prediction calculated from the surface torque and the drillstring geometry.

While the above objective functions are written somewhat generically, it should be understood that each of the drilling performance measurements may be related to multiple drilling parameters. For example, a representative equation for the calculation of MSE is provided in equation (6):

$$MSE = \frac{(\text{Torque} \cdot RPM + ROP \cdot WOB)}{HoleArea \cdot ROP}. \tag{6}$$

Accordingly, when optimizing the drilling performance measurement and/or the objective function, multiple drilling parameters, including two or more controllable drilling parameters, may be optimized simultaneously, which, in some implementations, may provide the generated operational recommendations. The constituent parameters of MSE shown in equation (4) suggest that alternative means to describe the objective functions in equations (1)-(5) may include various combinations of the independent parameters WOB, RPM, ROP, and Torque. Additionally, one or more drilling performance measurements may combine two or more of these parameters in various suitable manners; each of which is to be considered within the scope of the invention.

As described above, prior methods attempted to correlate a single control variable to the rate of penetration and to increase the rate of penetration by iteratively and sequentially adjusting the identified single control variable. However, as can be seen in the expressions below, changing parameters simultaneously can lead to a different outcome compared to changing them sequentially. Any objective function OBJ can be expressed as a function (or relationship) of multiple drilling parameters; the expression of equation (7) utilizes two parameters for ease of illustration.

$$OBJ=f(x,y) \tag{7}$$

At any time during the drilling process, determined operational updates produced by the present methods can be expressed as in equation (8).

$$\Delta OBJ = \left.\frac{\partial f}{\partial x}\right|_{x_{t_0}, y_{t_0}} \cdot \Delta x + \left.\frac{\partial f}{\partial y}\right|_{x_{t_0}, y_{t_0}} \cdot \Delta y \tag{8}$$

In the sequential approach, however, the change is achieved in two steps: a change at a first time and a second change at a subsequent time step, as seen in equation (9).

$$\Delta OBJ' = \left.\frac{\partial f}{\partial x}\right|_{x_{t_0}, y_{t_0}} \cdot \Delta x + \left.\frac{\partial f}{\partial y}\right|_{x_{t_1}, y_{t_1}} \cdot \Delta y \tag{9}$$

As a result, the two paradigms for identifying parameter changes based on an objective function may produce dramatically different results. As one example of the differences between the two paradigms, it can be seen that with the simultaneous update paradigm of equation (8), the system state at time $t_o$ is used to determine all updates. However, in the sequential updates paradigm of equation (9), there is a first update corresponding to x at time $t_o$. After a time increment necessary to implement this update and identify the new system state at time $t_1$, a second update may be processed corresponding to parameter y. The latter method leads to a slower and less efficient update scheme, with corresponding reduction in drilling performance. Exemplary operational differences resulting from the mathematical differences illustrated above include an ability to identify multiple operational changes simultaneously, to obtain optimized drilling conditions more quickly, to control around the optimized conditions more smoothly, etc.

As can be understood from the foregoing, the present systems and methods begin by receiving or collecting data regarding drilling parameters, at least two of which are controllable. The present technology then utilizes a statistical model, or possibly multiple statistical models, to identify at least two controllable drilling parameters that have significant correlation to one or more drilling performance measurements, which may be in the form of an objective function. The statistical model utilized to identify the at least two controllable drilling parameters having significant correlation to drilling performance measurements may be developed in any suitable manner. Exemplary statistical methods that may be utilized include multi-variable correlation analysis methods and/or principle component analysis methods. These statistical methods, their variations, and their analogous statistical methods are well known and understood by those in the industry. In the interest of clarity in focusing on the inventive aspects of the present systems and methods, reference is made to the various textbooks and other references available for background and explanation of these statistical methods. While the underlying statistical methods and mathematics are well known, the manner in which they are implemented in the present systems and methods is believed to provide significant advantages over the conventional, single parameter, iterative methods described above. Accordingly, the manner of using these statistical models and incorporating the same into the present systems and methods will be described in more detail.

The statistical methods of the present methods may be understood to include at least one model that describes the relationship between the objective function (or drilling performance measurement) and two or more of the multitude of drilling parameters. The statistical methods solve the model(s) for the optimal direction in the multi-dimensional parameter space to 1) identify the most significantly correlated drilling parameters, and 2) identify the nature of the correlation or relationship between the parameters and the objective function for use generating operational updates to the drilling parameters. Due to the dynamic nature of the drilling process, the statistical methods of the present systems and methods adapt to changes in the dynamics in real-time, or at least substantially real-time. By substantially real-time, it is to be understood that the present systems and methods are adapted to enable operators to determine operational updates during ongoing drilling operations rather than only after the operation, or stage of operation, has been concluded.

The types and quantity of data that can be generated or received during ongoing drilling operations can be voluminous. Performing statistical analysis on the entirety of this data may be impractical and doing so in at least substantially real-time may be effectively impossible. A variety of means may be used to reduce the amount of data being considered. Exemplary methods may utilize moving window analysis techniques combined with the selected statistical methods. For example, Moving Window Principal Component Analysis (MWPCA) and/or Moving Window Correlation Analysis (MWCA) may be used to identify the correlated drilling parameters and the nature of the relationship between the parameters and the performance measurements. In this regard, the term "Moving Window" refers to either a time-indexed or depth-indexed window that encompasses a stream of data. Principal Component Analysis and/or Correlation Analysis are used to extract a quantitative and/or qualitative model from the data within the window and to update the model adaptively as new data are received and obsolete data are removed.

Figure 4:
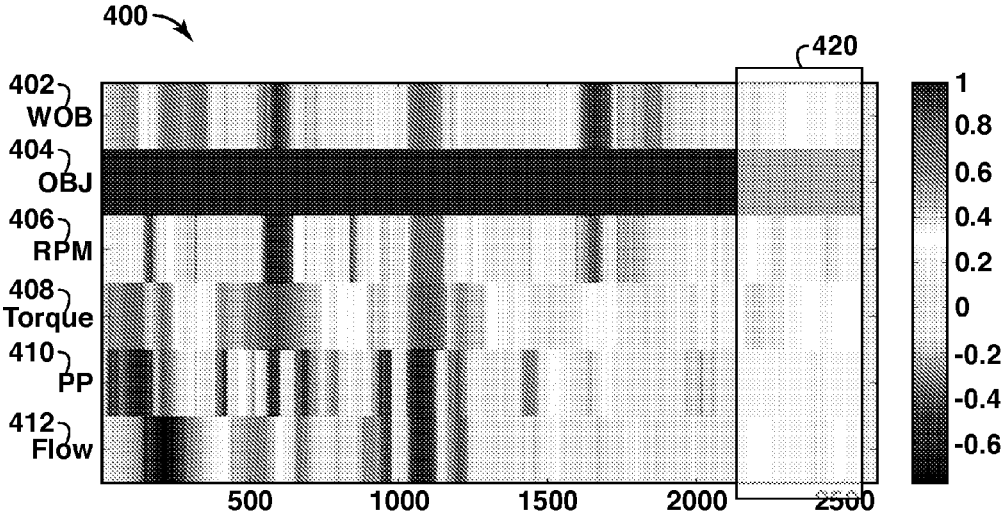
FIG. 4 illustrates schematically a method of utilizing a moving window algorithm on a data stream.

FIG. 4 provides an exemplary illustration of a data stream 400 during an ongoing drilling operation. The exemplary data stream illustrates the degree of correlation (between −1 and 1) between various drilling parameters and the selected drilling performance measurement. For example, FIG. 4 illustrates the correlation between rate of penetration (ROP) 404 and weight on bit (WOB) 402, rotations per minute (RPM) 406, torque 408, pipe pressure (PP) 410, and mud flow rate (Flow) 412; additional and/or alternative data regarding drilling parameters may be received depending on the relationships and methods implemented. As indicated above, at least two of the drilling parameters are controllable, such as the weight on bit, the rotations per minute, and the mud flow rate. FIG. 4 further illustrates a moving window at or near the leading edge of the data stream 400. The moving window is referred to as the analysis window 420, or the memory window, and is the window or subset of data on which the statistical methods are utilized. As used herein, analysis window and memory window are interchangeable. The analysis window 420 may be positioned in the data stream to analyze the most recently received data, such as the data for the last 50 feet drilled or for the last 10 minutes of drilling, or may be positioned offset from the most recently received data by a margin, such as to allow pre-processing of one or more of the parameters or to accommodate differences in collection, measurement, and/or calculation times of different parameters. In some implementations, the analysis window 420 is preferably positioned as close as possible to the leading edge of the received data so as to render the identified, correlated controllable drilling parameters as relevant as possible in real time. As can be seen, data exiting the analysis window relates to drilling and formation conditions at earlier, potentially obsolete times/depths in the ongoing drilling operation. While the data exiting the analysis window 420 is not considered by the statistical methods, it may be archived or stored for a variety of purposes, some of which are discussed further below.

As described above, the statistical model(s) utilized in the present systems and methods are adapted to identify at least two controllable parameters having significant correlation to drilling performance measurement(s). While analyzing an entire drilling operation may provide some value, analyzing too much data (such as the entire received data for an extended reach drilling operation) may be too computationally intensive to be practical and/or may be intractable. Similarly, it will be recognized that only the most recently received data is informative of the formation characteristics to be drilled. However, as can be appreciated from generalized statistical methods, too little data, or too small of an analysis window 420, may lead to instability in the statistical models and/or instability in the identification of parameters having significant correlation. In other words, the ability of the statistical model(s) to accurately and stably (i.e., without erratic and overly frequent changes) identify the significantly correlated drilling parameters and their relationships to drilling performance measurements will require an analysis window 420 length greater than a minimum window size (to provide stability) and usually smaller than the complete set of data (to provide tractability and timeliness). As will be described in greater detail below, some implementations may include a variable length analysis window that grows or expands in length as data is received until it reaches the predetermined window length. Such a variable length analysis window may be used when starting a drilling operation, after a change in lithology, after an abnormal drilling event, or in other circumstances.

Figure 5:
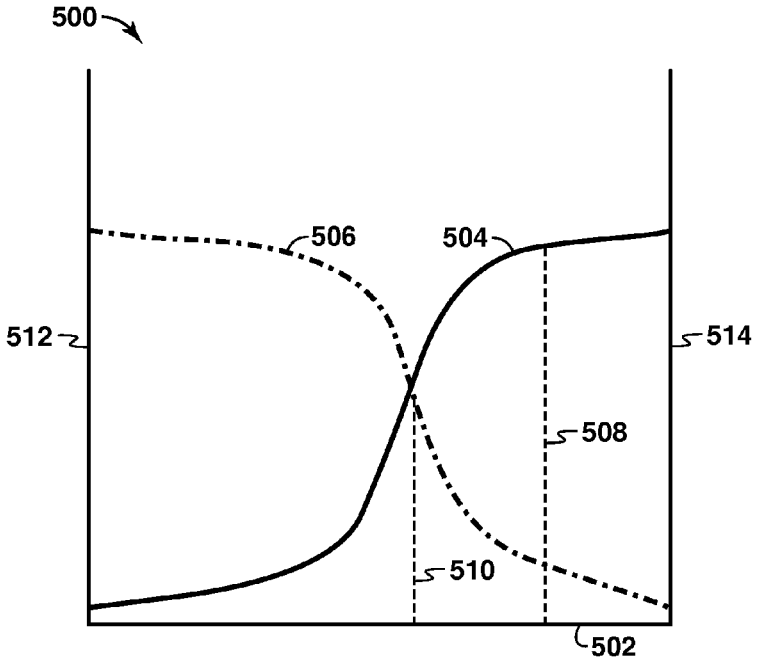
FIG. 5 illustrates an exemplary relationship between window size and various properties of a statistical correlation that may be used in the present invention.

FIG. 5 provides an illustrative example of the relationship between window size and various properties of the correlation. In the graph 500, the window size 502 is plotted on the x-axis and the stability 504 of the correlation determined using the statistical model(s) is plotted on the left y-axis 512. Additionally, the sensitivity of the correlation to indicate changes in drilling conditions, such as lithology changes, and/or to allow the operator to optimize controllable parameters based on current drilling conditions is plotted on the right y-axis 514, and is indicated in dash-dot lines as indicative/optimization ability 506. As can be seen, when the analysis window 420 is small, the correlation stability 504 is low and the ability to indicate changing conditions 506 is high. Accordingly, the operator may have updated and highly accurate identifications of the significantly correlated drilling parameters, but may receive them far too often leading to impractical implementation conditions. Similarly, sizing the analysis window 420 to maximize the stability 502, such as at the window size 508, may result in correlations that are unable to identify, and that are non-responsive to, lithology changes or other drilling condition changes.

Accordingly, there may be an optimal window size for the analysis window 420, which optimum may depend on the sensitivities and/or preferences of the operator. An exemplary optimum that may be identified on the graph 500 may be window size 510 where the stability and the indicative ability intersect. In the illustrative graph 500 of FIG. 5, the stability 504 and the indicative ability 506 are approximately mirrors of each other forming an intersection substantially at the middle of the transition zone. However, it should be understood that the graph of FIG. 5 is merely exemplary and that the stability 504 and the indicative ability 506 may have a variety of different forms resulting in a plurality of relationships between the two as possible optimums. In some implementations, the factors determining the stability and the indicative ability could be identified and the optimum window size could be identified mathematically, which could be adapted to provide an automated or substantially automated window size selection. Additionally or alternatively, other fixed window sizes may be selected by operators implementing the present systems and methods. Additionally or alternatively, two or more window sizes may be analyzed according to the present methods and used as "early warning" (fast response/short window) and "high probability" (slow response/long window) indicators.

Exemplary fixed window lengths for the analysis window 420 may be based on either time or on drilling distance. For example, the analysis window may have a length of between about 5 minutes and about 30 minutes. In some implementations, the window length may be between about 5 minutes and about 20 minutes, or between about 5 minutes and about 10 minutes. In implementations where the analysis window length grows as data is received, the lengths here described may be the predetermined window length after which the data exits the window. In other implementations, the analysis window may be between about 10 feet and about 100 feet, between about 25 feet and about 75 feet, between about 50 feet and about 100 feet, between about 50 feet and about 75 feet, or another suitable length. In some implementations, the analysis window length may be based on or proportionate to a pattern detection window length, as will be better understood with reference to the discussion below, such as being a given percentage larger than the pattern detection window. Still additionally, the analysis window length may be based at least in part on the conditions of the formation, which may be known or estimated based on past measurements and conditions on the well being drilled and/or on measurements and conditions observed while drilling a neighboring, or offset, well.

A fixed window length may be established for an entire drilling operation or multiple window lengths may be identified for a proposed drilling operation. For example, a prior drilling operation in the same field or formation may have identified depth ranges of consistent formation properties and depth ranges where the lithology or other formation property was in transition or changed frequently. In such implementations, the operators of the present systems and methods may elect a first analysis window size in the stages of the drilling operation where the formation was unchanging and a second analysis window size for stages of dynamic drilling conditions or formation changes. In such applications where the drilling is repeated for multiple nearby wellbores, these window lengths may be determined through a hindcast analysis of the offset well drilling histories to optimize the window length as a function of depth, and perhaps to predetermine depths at which abnormal events may be expected, such as an increasing likelihood of encountering a concretion, or hard drilling interval. For example, an analysis window length adapted to facilitate identification of lithology changes (i.e., shorter) may be preferred in depths of dynamic formation properties. Accordingly, the desired window size may be large enough to generate stable correlation estimates and small enough to be able to resolve changes in lithology. Furthermore, some implementations may establish the window length for the entire drilling operation, whether constant or varied over the operation as described above, and others may allow an operator to adjust the window length in response to observations and/or conditions during the drilling operation. For example, a bit may be dulling or may experience other degradations towards the end of a drilling interval or operation. The operator may choose window parameters to help preserve the bit to make it to the well total depth or some other milestone for optimizing the drilling operation. For example, the window parameters may be selected to allow the operator to respond more quickly to an increasing formation hardness.

Still additionally, some implementations of the present systems and methods may include a variable analysis window length. While the above description provides one example of an analysis window length that varies during the course of the drilling operation, the length is determined beforehand rather than in response to conditions encountered during drilling and is primarily available only when a planned drilling operation is in a formation expected to be analogous to a prior drilling operation. Due to the variability in formations, such applications may be limited.

Figure 6:
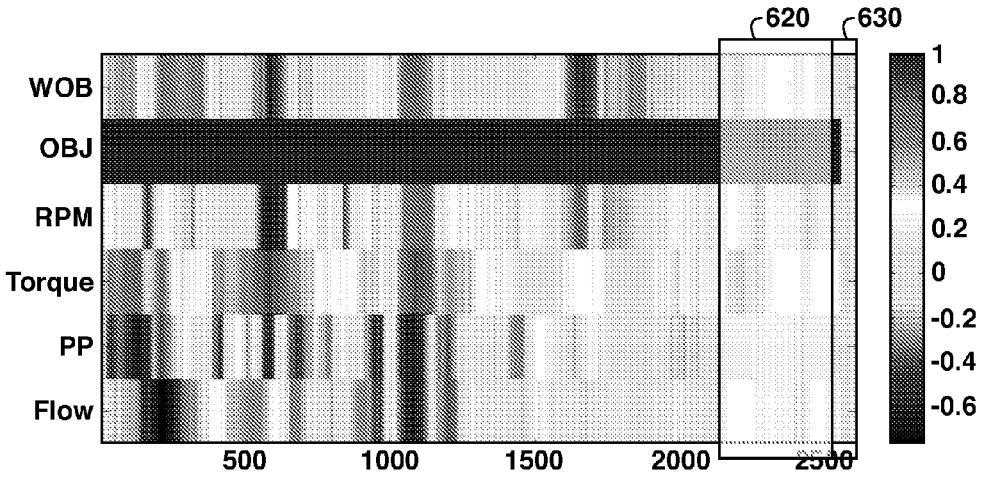
FIG. 6 schematically illustrates a method of utilizing a moving analysis window together with a moving pattern detection window.

Additionally or alternatively, systems and methods within the scope of the present invention may be provided with a pattern detection window in addition to the analysis window. FIG. 6 provides an illustrative data stream 600 similar to the stream of FIG. 4. As illustrated, the pattern detection window 630 includes received data just prior to the data entering the analysis window 620. Accordingly, the pattern detection window 630 and methods associated therewith may be considered an example of pre-processing methods that are performed on the received data before the statistical model is utilized to identify controllable drilling parameters having significant correlation to drilling performance measurements.

As has been discussed at length and can be understood from the nature of statistical analysis, the ability of the statistical models to identify the significantly correlated drilling parameters is dependent on the data in the analysis window 620 being applicable to the future operations. In other words, the drilling dynamics of the drilling operations in the analysis window should be at least somewhat similar to the drilling dynamics to be experienced in future operations if the statistical models are to produce relevant parameter identifications and/or operational recommendations. The pattern detection window 630 provides a smaller window of data that can be compared to the data in the analysis window 620 to identify instances where the underlying dynamics of the drilling operation change, such as when the drilling conditions change significantly and abruptly. Such instances may occur when there is a lithology change in the formation or some other change in the formation through which the drilling progresses. The drilling conditions or dynamics may change abruptly for other reasons, such as for any of the various unexpected conditions that can be encountered during drilling operations, such as bit dulling or even severe damage to the bit. The dual window approach allows the present systems and methods to capture the current process dynamics and to compare those dynamics with the dynamics of the drilling operation captured in the analysis window.

As illustrated in FIG. 6, the analysis window 620 is longer than the pattern detection window 630. The analysis window 620 may establish a baseline understanding or characterization of the formation and the drilling conditions. As described above, the analysis window 620 is sized or adapted to provide a stable characterization of the formation lithology. The pattern detection window 630, in contrast, is adapted to provide an indicator of changes in the formation or other drilling condition. Essentially, the pattern detection window 630 serves as a means to confirm or check the assumptions established by the analysis window 620. There are numerous ways to check whether data in a second data set is consistent with or an outlier to a first data set. Various statistical means may be used and the selection of a particular method may depend on the format or nature of the data to be considered.

The length of the pattern detection window 630 may be determined in one or more of the manners described above for the determination of the analysis window length. For example, it may be longer or shorter depending on the expected formation conditions, whether based on offset wells, based on hindcasting from the well being drilled, or based on a combination of these and/or other factors. In some implementations, the size of the pattern detection window and the size of the analysis window may be tied to each other, such as one being a predetermined fraction of the other. In some implementations, the length of the pattern detection window may be 25% of the length of the analysis window. In other implementations, it may be 20% as long, 15% as long, 10% as long, or 5% as long. In still other implementations, such as where the predicted formation conditions or drilling conditions are expected to be dynamic, the pattern detection window may be substantially smaller than the analysis window, such as less than 5% as long as the analysis window, to better identify changes in lithology or other changes in drilling conditions. In still other implementations, the length of the pattern window may be related to the typical length of formation depth intervals that may affect the drilling process. For example, pattern window lengths on the order of 2 to 3 feet may be appropriate for wells in formations that may have typical thicknesses of 10 to 30 feet. In particular, these windows lengths may be selected in consideration of the typical rate of drilling wherein shorter windows in depth may correspond to slower formation penetration rates.

One exemplary method for use in systems where the data stream comprises data regarding drilling parameters utilizes probability distributions to determine whether the second data set falls within or outside a specified level of significance of the estimated probability distribution. For example, the drilling parameter data in the analysis window 620 may be used to develop a probability distribution representing the parameter space in which additional data, such as data in the pattern detection window 630, is expected to fall. In the event that the data in the pattern detection window is an outlier when compared to the probability distribution space established by the analysis window at some level of significance, the outlier in the pattern detection window may indicate a change in lithology or other drilling condition. The present systems and methods may respond to an outlier indication in a variety of manners, as discussed further herein.

Figure 7:
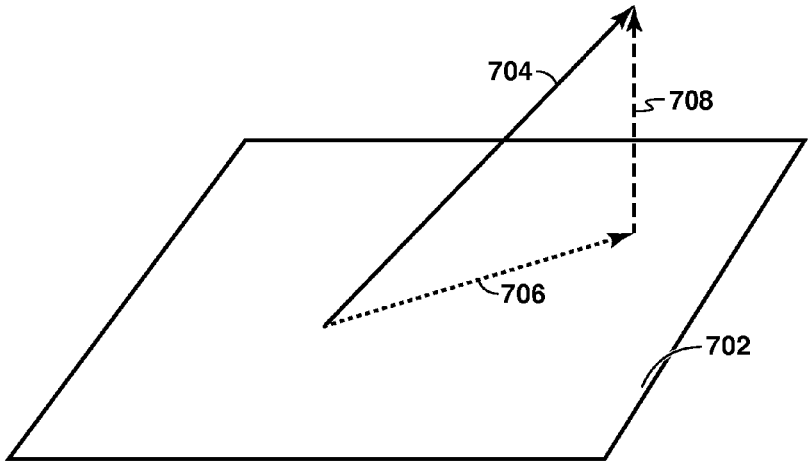
FIG. 7 is a graphical illustration of a residual-based method of comparing the analysis window data with the pattern detection window data.

Another exemplary method for comparing the pattern detection window 630 against the analysis window 620 for determining the continued validity of the dynamics characterized by the data in the analysis window may be referred to as a residual-based method. The residual-based methods may be implemented regardless of the statistical methods used to identify the significantly correlated drilling parameters, but will be described here in connection with methods utilizing principle component analysis. When using principal component analysis (PCA) to determine statistically and significantly correlated drilling parameters, the PCA calculation renders a total of K eigenvectors and K eigenvalues for the data within the analysis window. The greater the eigenvalue, the more important is the direction of the corresponding eigenvector. If the majority of the underlying drilling process in the analysis window is stable, the first m (m<K) eigenvectors, or principal vectors, that correspond to the first m dominant principal values will characterize the drilling conditions, whereas the remaining (K−m) non-significant principal vectors will characterize the abnormal drilling events. In other words, the m principal vectors define a principal space 702 representing the normal or expected drilling condition based on the data in the analysis window. m may be computed as the smallest positive integer that satisfies the following criteria equation:

$$\frac{\sum_{i=1}^{m}\lambda_i}{\sum_{i=1}^{K}\lambda_i} > \text{Threshold} \tag{10}$$

where $\lambda_1 \geq \lambda_2 \geq \ldots \lambda_K$ represent all the ordered principal values obtained from PCA, and the threshold is usually chosen to be higher than 0.5, typically closer to 0.9. With reference to FIG. 7, it can bee seen that these definitions come from the observation that the data vector 704 representing the data in the pattern detection window will lie within the principal space 702 when the drilling conditions are unchanged. In the picture, K=3, while m=2.

Assuming $W_m$ and $W_p$ are the window lengths for the analysis window 620 (or memory window) and the pattern detection window 630 respectively, X(i) represents a vector of values contained in the moving pattern detection window. Note that X(i) is itself a collection of smaller vectors $x(j)=[OBJ, WOB, RPM \ldots]_j^T$, which represents the measurements of all the K drilling variables at that time (or depth) instant j within the moving pattern detection window at that time (or depth) instant i. For example, $X(i)=\{x(i)=[OBJ, WOB, RPM \ldots]_i, x(i+1)=[OBJ, WOB, RPM \ldots]_{i+1}, \ldots, x(W_p+i-1)=[OBJ, WOB, RPM \ldots]_{wp+i-1}\}^T$. Thus, a sequence of pattern vectors within an analysis window may be expressed as follows:

$$X = \{X(1), \ldots, X(i), \ldots, X(W_m)\} = \left\{ \begin{bmatrix} \underline{x}(1) \\ \underline{x}(2) \\ \vdots \\ \underline{x}(W_p) \end{bmatrix}, \ldots, \begin{bmatrix} \underline{x}(i) \\ \underline{x}(i+1) \\ \vdots \\ \underline{x}(W_p+i-1) \end{bmatrix}, \ldots, \begin{bmatrix} \underline{x}(W_m) \\ \underline{x}(W_m+1) \\ \vdots \\ \underline{x}(W_p+W_m-1) \end{bmatrix} \right\}_{K \cdot W_p \times W_m} \tag{11}$$

Note that X(i) must be cast as a single column vector, i.e. a concatenation of all the x's within each pattern detection window. Thus, if x(j) has K drilling variables, the pattern detection window X(i) has size $K \cdot W_p$ by 1, the analysis window data X has dimension of $K \cdot W_p$ by $W_m$, Assuming that the pattern detection window is moved at the time (or depth) instant i, the data vector X(i) 704 representing the data in the pattern detection window will lie within the principal space 702 when the drilling conditions are unchanged. However, when the formation lithology changes or when other drilling conditions result in a change in the drilling conditions, and therefore a change in the drilling parameter data in the pattern detection window, X(i) will be outside the principal space 702, such as indicated in FIG. 7. By subtracting the projection 706 of data vector X(i) 704 onto the principal space 702, a vector is derived, which can be referred to as the "residual vector" 708 as seen in equation (12):

$$R(i) = X(i) - \sum_{k=1}^{m} \langle X(i) \cdot v_k \rangle v_k^T \tag{12}$$

where superscript T is the matrix transpose operator, the $i^{th}$ principal vector of the analysis window $v_k$ has $KW_p$ by 1 dimension, and the selected m principal vectors $V=[v_1, \ldots, v_m]_{KW_p \times m}$ are associated with the pattern detection window. The dot product $(X(i) \cdot v_k)$ is the projection of vector X(i) (representing the pattern detection window data) on the $k^{th}$ principal vector $v_k$.

Other methods can also be used to estimate the residual vector or residual amplitude. For example, the amplitude of the residue can be obtained by calculating the Mahalanobis distance $(X-\mu)^T\Sigma^{-1}(X-\mu)$, where μ is the estimated mean of X, and Σ is the estimated covariance matrix of X. This definition eliminates the need to pre-select the number of eigenvectors m in the first formula, while providing practically similar results.

By definition, the norm of residual vector R 708 is nothing but the distance from a drilling data record to its projection 706 in the principal space (as shown in FIG. 7). The norm of the residual vector 708 is a measure of how biased the current drilling condition, or the conditions in the pattern detection window, is from the drilling conditions characterized by the analysis window. For example, if the norm of the residual vector is 0, the data in the pattern detection window is consistent with the data in the analysis window. However, residual vector norms greater than a threshold value represent abnormal or unexpected drilling conditions. As discussed above, an indication that the developing drilling conditions (i.e., the data in the pattern detection window) deviate from the data in the analysis window may be responded to in a variety of ways according to the present systems and methods. As illustrative examples, the present systems and methods may respond by repeating the step of identifying the significantly correlated, controllable drilling parameters. Additionally or alternatively, the analysis window 620 may be emptied to be repopulated with data representative of the changed drilling condition. Additionally or alternatively, archival data may be accessed until the analysis window has been sufficiently repopulated with data representative of the changed condition. These and other responses will be discussed further below.

Referring back to FIG. 2, it will be recalled that the present systems and methods include receiving data regarding drilling parameters and utilizing a statistical model to identify at least two controllable drilling parameters having significant correlation to at least one drilling performance measurement. The foregoing discussion highlights the various manners in which the data may be received and how various statistical methods and/or models can be used to identify the significantly correlated drilling parameters and, in some implementations, generate operational recommendations for at least two controllable drilling parameters. In the interest of ensuring clarity, additional details regarding an exemplary implementation utilizing moving window principal component analysis (PCA) are provided here.

PCA is a powerful data analysis tool that can efficiently discover dominant patterns in high dimensional data and represent the high dimensional data volume in a much lower dimensional space by using linear dependence among the parameters. See, e.g., I. T. Jolliffe, Principal Component Analysis, Springer-Verlag, New York, Inc., 2002; and S. Wold, Principal Component Analysis, Chemometrics and Intelligent Laboratory Systems, 2 (1987) 37-52. PCA has been widely used for computer vision, bio-informatics, medical imaging and many other applications. In PCA, Principal Values (eigenvalues of the covariance matrix of all parameters) and Principal Vectors (eigenvectors of the covariance matrix) of a multi-dimensional data set can be calculated, and the Principal Vectors are ordered in decreasing order according to the corresponding Principal Values. Each principal vector explains a percentage of data variation proportional to its principal value. For most datasets, each data record in the underlying data set can be well approximated by a linear combination of the first few dominant Principal Vectors.

PCA can be applied to data in an online and continuous manner to extract the dynamic relationship between parameters of interest, which in this case are the ROP, MSE, and the other drilling parameters (WOB, RPM, Mud Rate, Pump Pressure, vibrations etc.). The extracted linear relationship between ROP, MSE, and the drilling parameters can be used to guide changes of drilling parameters in order to move drilling performance in a favorable direction. When PCA-based statistical methods are utilized, quantitative operational recommendations can be generated. Additionally or alternatively, and as discussed above, correlation analysis between ROP, MSE, and drilling parameters can be used to provide a locally optimal "gradient" direction that indicates how the drilling parameters can be changed so as to obtain the steepest increase in whatever objective function to be maximized. It should be recognized without departing from the scope of the invention that alternative objective functions may be comprised such that the optimal value corresponds to a minimum, in which case the steepest decrease in the objective function is determined.

Figure 8:
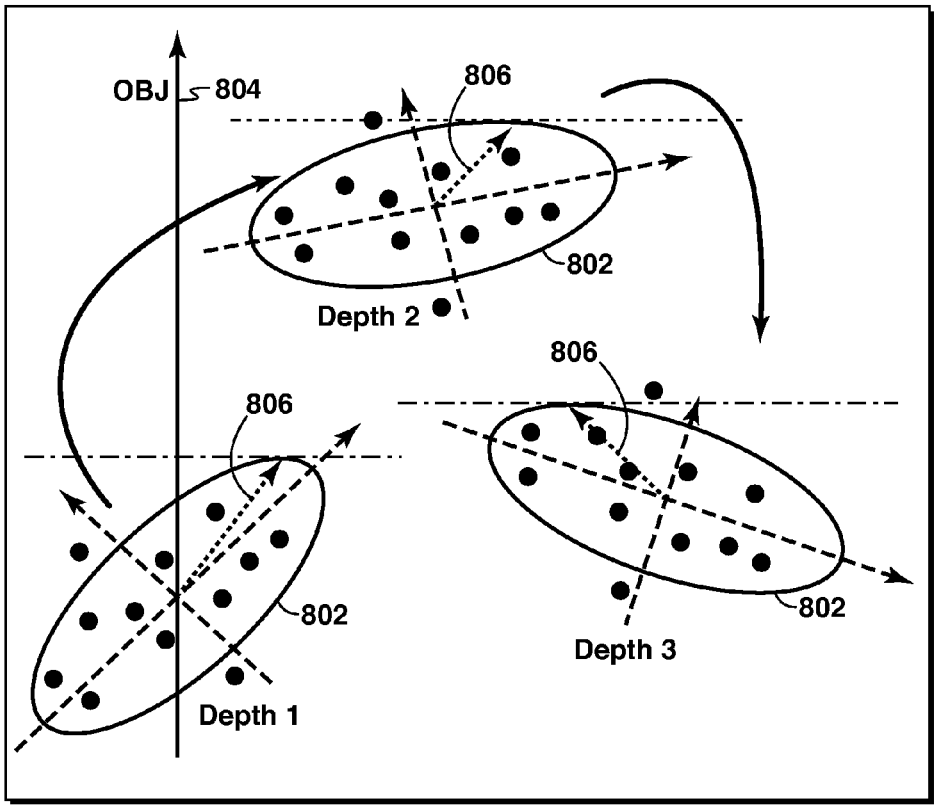
FIG. 8 is a simplified graphical representation of a PCA-based method of generating operational recommendations.

For a stream of dynamic drilling data, the present systems and methods take as input a window of drilling data from time or depth instant, i to $(i+W_p-1)$, where $(i+Wp-1)$ is the present index and $W_p$ is a pre-selected pattern detection window size. A proper $W_p$ can be selected by the user based on prior geological or geophysical knowledge about the subsurface to be drilled, or through an automatic selection algorithm as discussed above, and can be changed anytime during the drilling process. For a given $W_p$, values of all the drilling parameters within the pattern detection window are known, i.e., $X(i)=\{x(i)=[OBJ, WOB, RPM \ldots]_i, x(i+1)=[OBJ, WOB, RPM \ldots]_{i+1}, \ldots, x(W_p+i-1)=[OBJ, WOB, RPM \ldots]_{wp+i-1}\}^T$ are known or received, where OBJ stands for the objective function, which may be chosen from equations. (1)-(5) or other suitable functions. These points may be represented as scattered points in a K-dimensional space where K is the number of drilling parameters collected, as shown in FIG. 8. Qualitatively, PCA on this subset of drilling data for each point in time (or depth) provides the axes of the ellipsoidal region that encompasses the points, shown as the plurality of ellipses 802 in FIG. 8. The vertical axis 804 in FIG. 8 identifies the direction of increasing OBJ. The arrow 806 in each ellipse 802 shows the direction of change that provides a maximum increase in OBJ within the ellipse 802.

This pictorial explanation can be made more precise by means of the mathematical formulation below. We can use the following equation to compute the mean vector and covariance matrix for the analysis memory window X as defined in equation (9):

$$\overline{X}=E(X)$$

$$\Sigma=E[(X-\overline{X})(X-\overline{X})^T] \tag{13}$$

where E(•) is the mathematical expectation operator. Note that equation (13) provides one way to estimate the mean vector and covariance matrix; but other methods may also apply. The data may be expressed in dimensionless units by normalizing the data, e.g. dividing each by a standardized maximum value which would make each entry in the vector a fraction between 0 and 1. As described above, a moving window PCA algorithm may be used to update the mean vector and covariance matrix in equation (13), as well as eigenvalues and eigenvectors of the covariance matrix for each time window. See, e.g., Xun Wang, Uwe Kruger, and George W. Irwin, Process Monitoring Approach Using Fast Moving Window PCA, *Ind. Eng. Chem. Res.* 2005, 44, 5691-5702. In this approach, the impact of obsolete data points is removed from the mean and covariance, and the impact from new data points is added without having to re-compute the entire matrix.

An alternative method to compute the mean and covariance in a dynamic manner is the method of exponential filtering. In this case, one does not need to store in memory all the pattern vectors belonging to an analysis window. The analysis window is replaced by an exponential weighting that decays rapidly for older pattern vectors and weights the most recent ones highly. The formulas that enable this method are given below:

$$X(t)=\mu X(t)+(1-\mu)\overline{X}(t-1)$$

$$\Lambda(t)=\mu X(t)[X(t)]^T+(1-\mu)\Lambda(t-1)$$

$$\Sigma(t)=\Lambda(t)-\overline{X}(t)[\overline{X}(t)]^T \tag{14}$$

Additionally or alternatively, some implementations may use different weighting function methods for the analysis and pattern detection windows, including linear, quadratic, Hanning or half-Hanning taper windows, etc. These windows would be used to gradually decrease the effect on the solution of older data in the analysis window that is about to exit the window. Such methods may tend to generate smoother transitions as the underlying drilling conditions change.

This way the new mean and covariance matrix estimates are continuously updated using the old ones without a need to use all the values in the analysis window. μ is known as the "memory parameter", and although it doesn't strictly imply a fixed analysis window, it produces results comparable to using an analysis window of size roughly 1/μ. Suitable values of μ can be chosen to be $0.1/W_p$ or less to obtain sufficient samples to compute the mean and covariance matrix reliably for a given pattern detection window size $W_p$. The residue changes faster for larger values of μ, and the detection of change is more sensitive, but this can also lead to too many false alarms due to temporary excursions of the data. Conversely, too small a value for μ can result in very slow detection and missed events. The method may involve two or more values of the smoothing parameter μ in order develop "fast" and "slow" process parameters as discussed above. Finally, other weighting schemes may be applied to the data, with the exponential weighting being a special case. Examples include weighting based on confidence-intervals around measurements in X, or other desired sub-sampling schemes.

With the notation of mean vector and covariance matrix for each window, we can now formulate the following optimization problem, $$OBJ_{max}=\mathrm{Max}_{\vec{V}}\,\vec{V}^T\cdot\vec{C},$$

subject to:

$$\vec{V}^T\cdot\Sigma^{-1}\cdot\vec{V}\leq L.$$

where, $\vec{C}=[10 \ldots 0]^T$ (1 at OBJ location)

Σ=correlation matrix $\vec{V}$=gradient vector.

In posing this problem, the covariance matrix is ranked in the sequence such that correlations of OBJ to all other parameters are in the first column of the matrix (or row due to symmetry of the matrix). The solution to the optimization problem, $V_{opt}$, provides the optimal direction from the current mean values of drilling parameters that would result in maximum rate of OBJ increase. This adjustment is subject to the constraint that the system does not stray outside the region containing most of the observed data, or normal operating region. The normal operating region is outlined by the constant L in the above equation. In the case of normalized vectors, L can be set as a large percentage number (e.g. 90%) to capture a region that contains most of the drilling data. It can be proven through standard penalty function method for solving linear constrained optimization problems that the solution to the above problem can be written as, $$\vec{V}_{opt}=\sqrt{L}(\Sigma\cdot\vec{C}) \tag{15}$$

where $\Sigma\cdot\vec{C}$ a is exactly the vector containing all correlation coefficients between OBJ and the other drilling variables.

To summarize, at each point (time or depth) of the drilling process, the mean vector and covariance matrix of all drilling parameters within a certain window of the point are calculated according to equation (13). The vector $V_{opt}$ is then computed according to equation (15). The components of $V_{opt}$ indicate the changes that need to be made to all of the drilling parameters in order to reach the optimal OBJ locally. This process can be repeated at consecutive points during the drilling process to optimize the entire drilling process.

Figure 9:
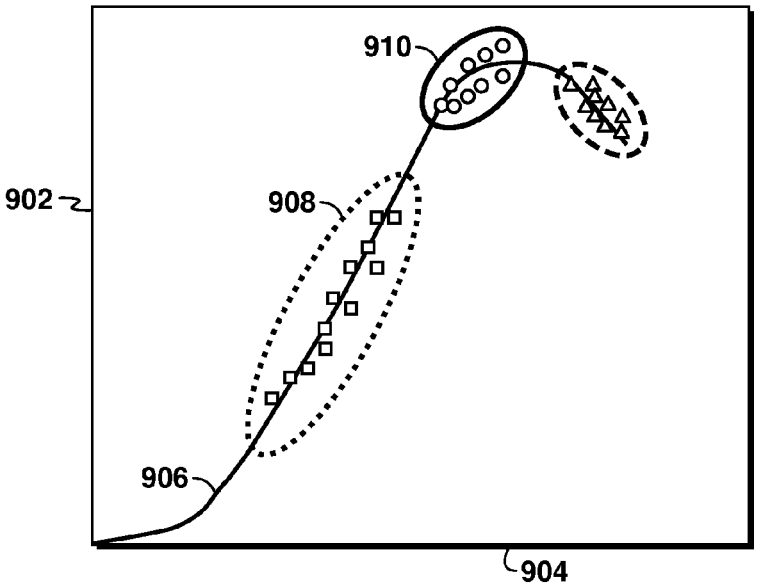
FIG. 9 illustrates the relationship between rate of penetration and weight on bit.

In the special case when ROP is the objective function, the goal of the operation is to maximize drilling speed, which is facilitated by the simultaneous consideration of two or more controllable drilling parameters. FIG. 9 illustrates the relatively simplified analysis where rate of penetration is correlated to the weight on bit and all other drilling parameters are assumed to be fixed. As is understood, rate of penetration increase is constrained by founder points and concerns of potential damage to drilling equipment. The present systems and methods provide operational recommendations to enable operators to achieve highest possible ROP without risking the equipment. FIG. 9 illustrates a commonly accepted relationship between rate of penetration 902, along the y-axis, and weight on bit 904, along the x-axis. Specifically, the graph in FIG. 9 illustrates the linear relationship between the rate of penetration and the weight on bit until the founder point is reached, which can be identified as the point where the tangent to the ROP-WOB curve 906 separates from the linear segment correlated from the data points in ellipse 908. When drilling in the linear regime 908 (below the founder point), correlation between rate of penetration and weight on bit data will suggest increasing weight on bit to achieve higher rate of penetration.

When approaching the founder point, the positive correlation between rate of penetration and weight on bit starts weakening. It has been found that the reduction in slope of the local tangent often corresponds to increasing MSE. In some implementations, some dynamic dysfunction may be observed in the system once the slope of the tangent to the curve begins to decrease. Although some additional increase in rate of penetration may be achieved by continuing to increase weight on bit, it has been shown that this is not beneficial in the long run since damage to equipment is likely. Footage per day is more likely to be maximized by operating at or below the founder point, or the point at which dysfunction begins to be observed, which is also the point at which MSE begins to rise. Accordingly, the present systems and methods may utilize objective functions to represent drilling performance, which objective functions may incorporate two or more drilling performance measurements. For example, objective functions may be utilized that relate rate of penetration and MSE so as to identify the optimum rate of penetration as the highest rate of penetration without increasing the MSE. An exemplary relationship may be the ROP-to-MSE ratio. This objective function attempts to achieve optimal tradeoff between drilling speed and energy consumption efficiency during drilling. In other words, it maximizes the ROP per unit energy input. Furthermore, in some implementations, the marginal increase in ROP relative to the marginal increase in MSE may be considered important. In this case, it is more reasonable to use an objective function that is the ratio of percentage increase in ROP to percentage increase in MSE. Additional relationships may be implemented as the objective function. For example, suitable relationships may be implemented to mathematically identify the founder point 910 where the slope of the tangent to the curve begins to decrease. Operational recommendations may be generated to increase the rate of penetration to this point on the rate of penetration curve without exceeding the founder point.

Figure 10:
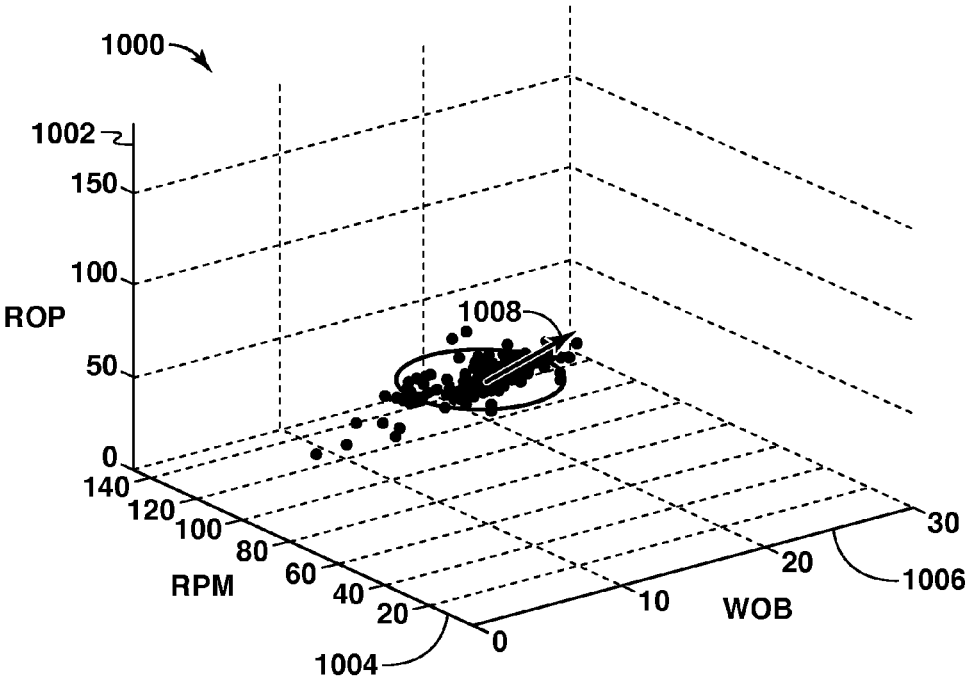
FIG. 10 illustrates the relationship between rate of penetration, weight on bit, and rotation rate.

While the above discussion illustrates the advantages of utilizing objective functions incorporating two or more drilling performance measurements, the simplification of a single controllable drilling parameter (weight on bit) can be improved upon by generalizing to the multi-dimensional case. As described above, the present systems and methods may be adapted to generate operational recommendations for at least two controllable drilling parameters. FIG. 10 shows scatter plot 1000 of ROP-RPM-WOB data within a 100 ft interval received from a real well dataset (i.e., the window size illustrated is 100 feet). The rate of penetration 1002, the rotations per minute 1004, and the weight on bit 1006 are plotted along the indicated axes. Statistical analysis, such as PCA analysis or correlation analysis, is able to identify the optimal direction in RPM-WOB space to achieve higher ROP, illustrated by vector 1008. Depending on the statistical methods utilized, the present systems and methods may generate a directional or qualitative operational recommendation for the two or more drilling parameters and/or may provide a quantitative operational recommendation, which may include an incremental change to a drilling parameter and/or a target parameter value.

With reference to FIG. 6 and as discussed above, the present systems and methods may utilize a dual-window analysis method in which the received data is analyzed in a pattern detection window 630 before passing into the analysis window 620. The use of the dual-window method enables the systems and operators to determine if the current drilling conditions are consistent with the data in the analysis window. As can be understood, the present statistical methods can be computationally intensive to perform on a new set of data at each data point. For this reason, the moving window methodology may be employed to facilitate and accelerate the systems and methods. However, a single moving window technique may be less accurate, and possibly misleading, when incoming data characterizes drilling conditions divergent from past drilling conditions. Accordingly, in some implementations, the use of a dual-window methodology may enable the operator to determine whether an abnormal event or some other significant change in the underlying drilling conditions may have occurred, in which case the drilling operator may be alerted to a possible downhole event that requires further investigation.

In some implementations where the data in the pattern detection window 630 indicates a change in drilling conditions, formation conditions, etc., the present systems and methods may empty the analysis window 620, which may include deleting the data therein and/or moving the data to an archive or for use in other methods. However, the present systems and methods rely upon data in the analysis window to generate operational recommendations. In some implementations, the present systems and methods may be adapted to indicate to the operator that data is being collected before an operational recommendation can be generated. Additionally or alternatively, the present systems and methods may be adapted to vary the size of the analysis window following the identification of a change in drilling conditions, such as by the occurrence of an abnormal vector in the above residual-based methods. In some implementations, the analysis window may be adapted to be the size of the data in the pattern detection window and to grow as additional data is received until reaching its original or standard length. By adjusting down to the amount of data available, the present systems and methods may be able to continue generating operational recommendations despite the change in drilling conditions, which is precisely the time when recommendations are most desirable.

Figure 11:
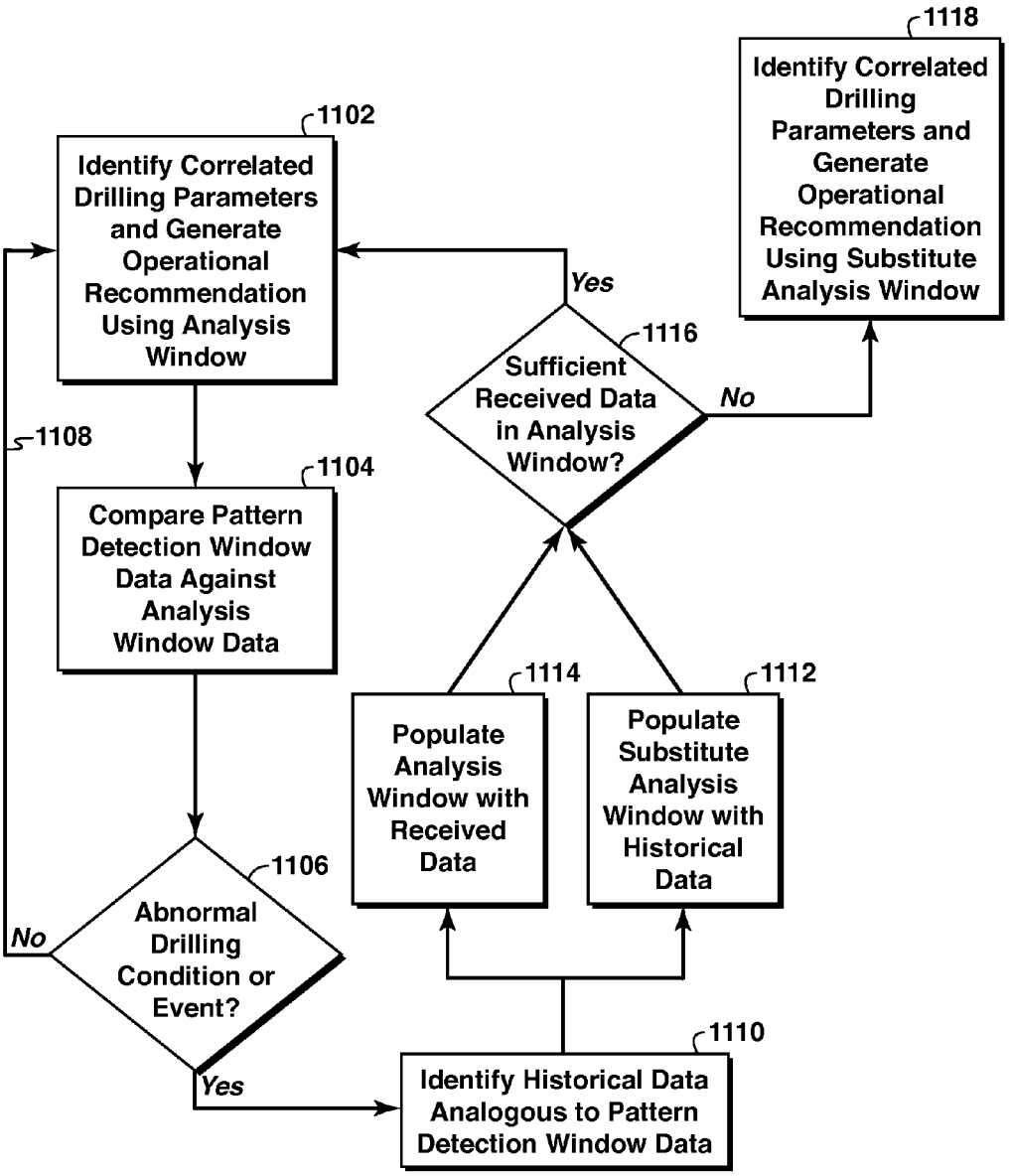
FIG. 11 is a flow chart of methods of using historical data in the present systems and methods.

Additionally or alternatively, some implementations may utilize a historical data matching algorithm to continue generating operational recommendations despite a change in drilling conditions or a detection of an abnormal event. An exemplary flow chart 1100 is illustrated in FIG. 11 for facilitating discussion. The historical data matching algorithms are premised on the understanding that drilling operations are analogous between different depths of the same well or between different wells drilled in the same or similar fields. For example, adjacent wells in the same field may be expected to encounter similar formations at similar depth ranges. Accordingly, a drilling condition identified as new to the present dual-window methods may be similar or even identical to segments of previous drilling operations.

As illustrated in FIG. 11, some implementations may begin as described above, by identifying correlated drilling parameters and/or generating operational recommendations based on data in the analysis window, at 1102. Using the dual-window approach, the pattern-detection window data may be compared against the analysis window data, at 1104, to determine whether an abnormal drilling condition or event is occurring, at 1106. If the drilling and/or formation conditions have not changed and there is not another abnormal drilling event, the methods may continue as described above and as illustrated by flow path 1108. However, if an abnormal drilling condition or event is identified at 1106, the method may proceed to identify historical data analogous to the pattern detection data, at 1110.

The identified historical data may be used to populate a substitute analysis window, at 1112, while the received data continues to populate the analysis window, at 1114. While doing so, the method may calculate the consistency of the received data with the identified historical data in the same way that the pattern window data is compared with the analysis window data. The received data continues to accumulate in the analysis window while the method checks to see if there is sufficient data in the analysis window, at 1116. While the analysis window is insufficiently populated, the method may utilize the substitute analysis window to identify correlated drilling parameters and to generate operational recommendations, at 1118. When the analysis window has accumulated sufficient received data, the method returns to identifying correlated drilling parameters and generating operational recommendations based upon the analysis window, at 1102. Alternatively, in some implementations, the historical data may be used to anticipate an upcoming abnormal event and thereby be prepared to switch the buffers as described above, to facilitate more rapid response to the changing conditions.

The flow chart 1100 of FIG. 11 is merely representative of the manners in which data in a historical library may be used in augmenting the present systems and methods. As another example, the data may be indexed or otherwise categorized to identify data patterns leading up to an abnormal drilling condition or event or a change in drilling condition. The historical data and the received data, whether in the analysis window or the pattern detection window, may be compared and matched using any suitable and standard pattern recognition techniques, including those based on principal vector analysis.

Another adaptation of the present systems and methods particularly suited for circumstances when abnormal drilling conditions or events are identified may include systems or methods for informing the operator that the results or recommendations from the present methods are preliminary, based on limited data, based on historic data, or otherwise different from the standard outputs. For example, the results and recommendations may be accompanied by an asterisk or color-coded such that an operator considering a generated operational recommendation will know that the generated recommendation may not merit the same consideration as a standard recommendation from the present systems and methods. For example, in substantially automated systems where the generated recommendation is presented for confirmation by a single operator button push, the system may respond to the standard button push with a request to reconfirm knowing that the recommendation is based on historical (or incomplete) data. Depending on the nature of the equipment and the operations, the notice to the operator may be best given by audible signal or other sensory signal.

Continuing with the discussion of adaptations suited for use in connection with drilling abnormalities or changing conditions, the present systems and methods, including the results therefrom, may be adapted to detect, classify, and/or mitigate abnormal drilling events. When an abnormal event occurs, its "signature", which is comprised of the set of drilling parameters and possibly other associated indirectly estimated parameters, e.g. the rock type, can be stored in a historical database. Signatures of new abnormal events can then be automatically compared to previous ones in the database to enable rapid event diagnosis. This can be done through many different data mining technologies. Exemplary methodologies include the PCA-based residual analysis, such as was discussed above for identification of abnormal conditions. The residual analysis introduced above provides tools and methods to detect the occurrence of abnormal drilling events or conditions. Since these abnormal events, such as bit balling, bottom hole balling, whirl, stick-slip, etc., are caused by different conditions, distinctive fingerprints are expected in the high-dimensional drilling parameter space. By comparing the fingerprint of the data in the pattern detection window (the data that triggered the identification of an abnormality) to data in a historical library, or more particularly, a library of data categorized or classified as being indicative of one or more types of abnormal events, the present systems and methods can quickly identify the abnormality as a drilling event or condition rather than a change in formation properties. Moreover, the present systems and methods may be adapted to identify the type of drilling event and appropriate steps to mitigate the abnormality, such as operational recommendations to reduce vibrations. The ability to identify an abnormal drilling event at its onset will allow timely adjustment in drilling operations to mitigate the problem and avoid further damage.

As indicated, the received data is expected to have a signature. Or rather, accumulations of data points are expected to carry identifiable information, or proverbial signatures or fingerprints. In some implementations, received data corresponding to abnormal drilling events, such as the abnormal vectors discussed above, may be clustered together for identification. The signatures of these clusters are then compared to benchmark signatures (extracted from previously studied and labeled drilling data) of different abnormal events. This categorization will enable quick identification of the cause of the abnormal events. There are many different methods of clustering. In particular, popular methods known as K-means clustering, Classification and Regression Trees (CART), Bayesian methods and many of their variants are commonly available in most data processing software. Any suitable clustering methodology may be used.

While the above description is believed to describe the present systems and methods in a reproducible manner, various examples are provided herein to illustrate specific aspects of the present invention. The examples are provided for illustrative purposes only and are not intended to limit the scope of the foregoing description or the following claims.

Figure 12:
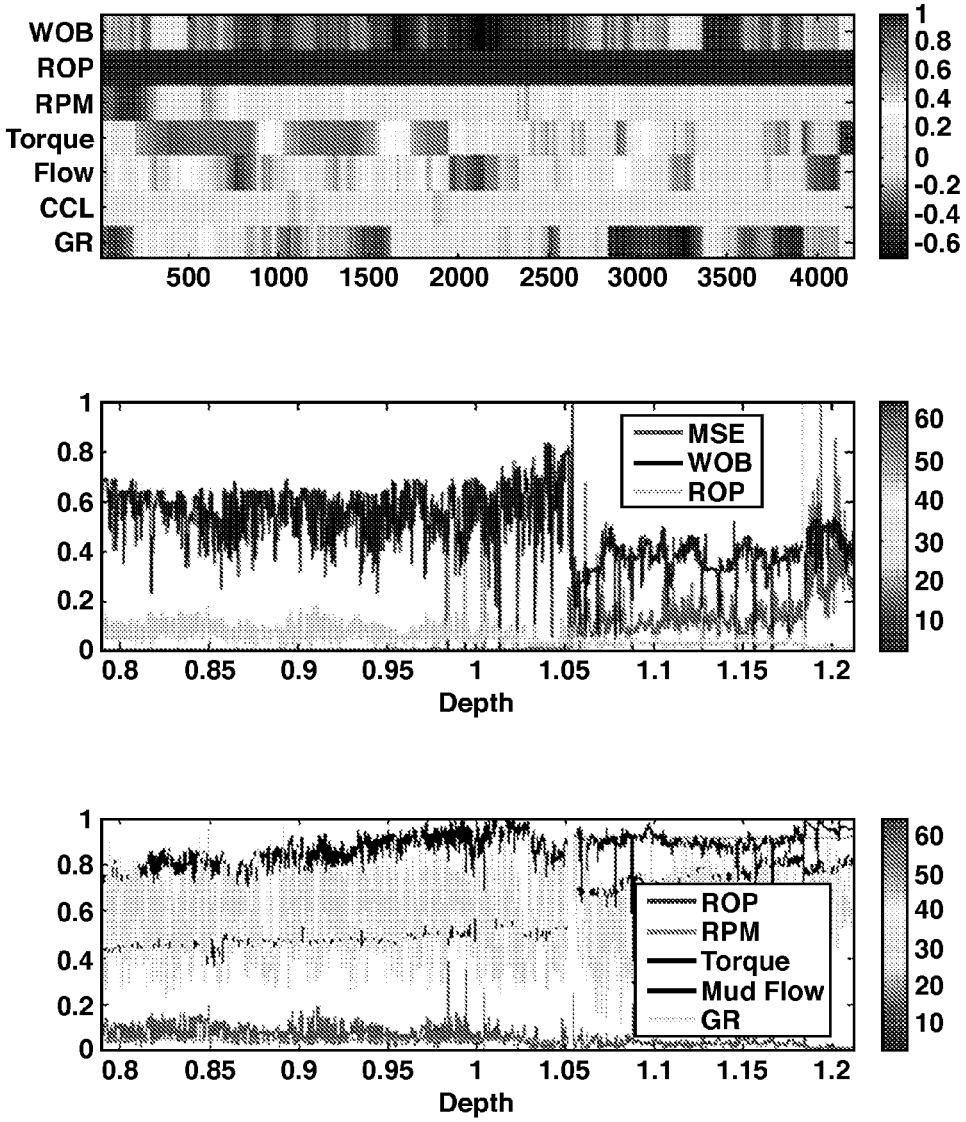
FIG. 12 provides representative data utilized in the present systems and methods showing the correlation of drilling parameters with rate of penetration.
Figure 13:
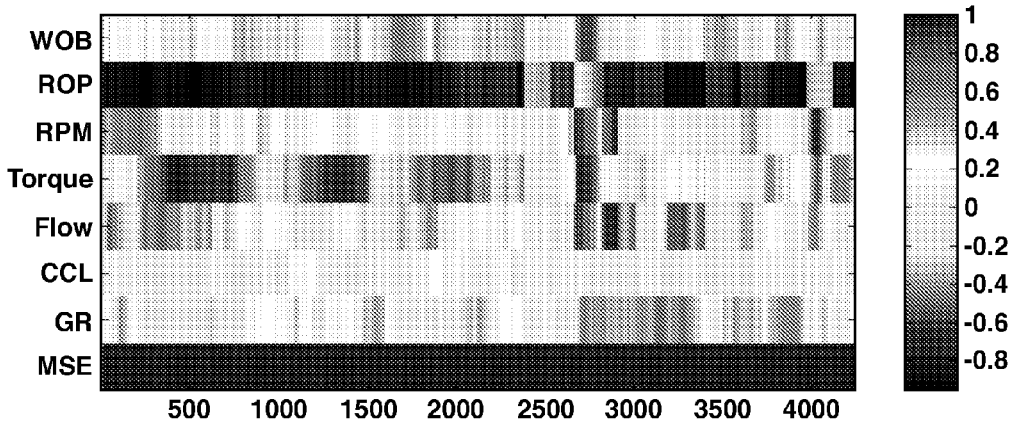
FIG. 13 illustrates the correlation history of drilling parameters with mechanical specific energy (MSE) for the data in FIG. 12.

The first example presented here is taken from the dataset for a representative well. Rate of penetration (ROP) was used as the objective function in this case. The top plot in FIG. 12 is the history of $V_{opt}$. Each vertical line in the plot shows the correlations of all drilling parameters, and hence $V_{opt}$, with ROP at each drilling data recording point. Strong colors indicate strong correlation. For example, in the bottom two plots of the actual drilling variables (normalized), we can see large natural variability in all drilling variables, which indicates robustness in the correlation calculation. It is seen from this dataset that correlation varies significantly, with strong negative correlation with WOB and positive correlation with RPM. Such observation suggests reducing WOB and increasing RPM to improve drilling performance. FIG. 13 shows the correlation history of drilling parameters with MSE for the same dataset. WOB in this case is positively correlated to MSE during most of the drilling process (as it is desirable to reduce WOB to minimize MSE in the drilling process). This confirms the validity of the recommendation to reduce WOB based on ROP correlation. Combining with the result in FIG. 12, lowering WOB will lead to a simultaneous increase in ROP and reduction in MSE for this case. This example shows the potential improvement that can be made to current drilling practice when, alternatively or collectively, (1) two or more controllable drilling parameters are varied simultaneous, or (2) two or more drilling performance measurements are incorporated into an objective function. The strong negative correlation between ROP and MSE is likely due to drilling in an inefficient regime of the ROP curve dominated by stick-slip vibration dysfunction. Referring back to FIG. 9, the drilling system is apparently operating beyond both the founder point and the peak ROP.

Figure 14:
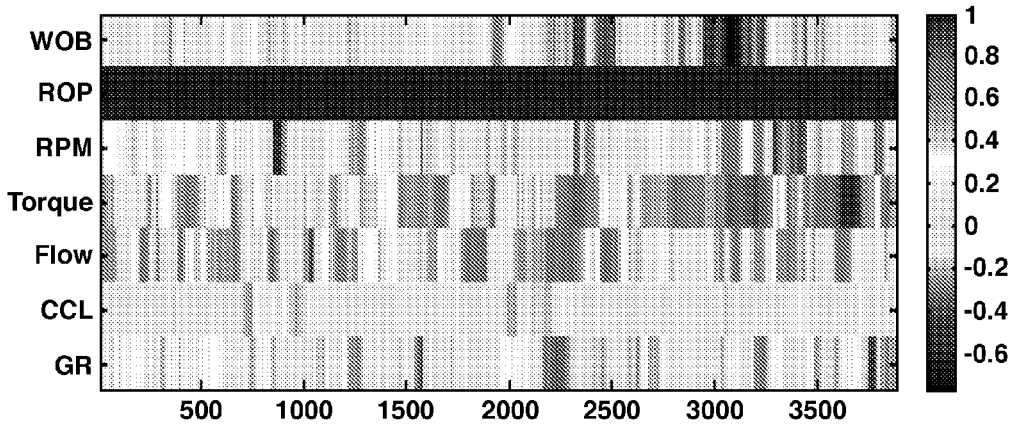
FIG. 14 provides representative data and correlations similar to FIG. 12 but for drilling operations in a different formation.

The second example is shown in FIG. 14. The result is obtained for the same well in the previous example but at shallower depth with a larger hole size (8.5-inch). Again, the objective function is ROP maximization. The key observation for this set of data is that the Mud Flow Rate, a variable that is not typically adjusted using MSE analysis, exhibits strong positive correlation with ROP. A possible explanation for this observation is that at shallower depth and larger holesize, the borehole cleaning rate affected ROP significantly. Here again, the benefits of considering drilling parameters in addition to weight on bit can be seen.

Figure 15:
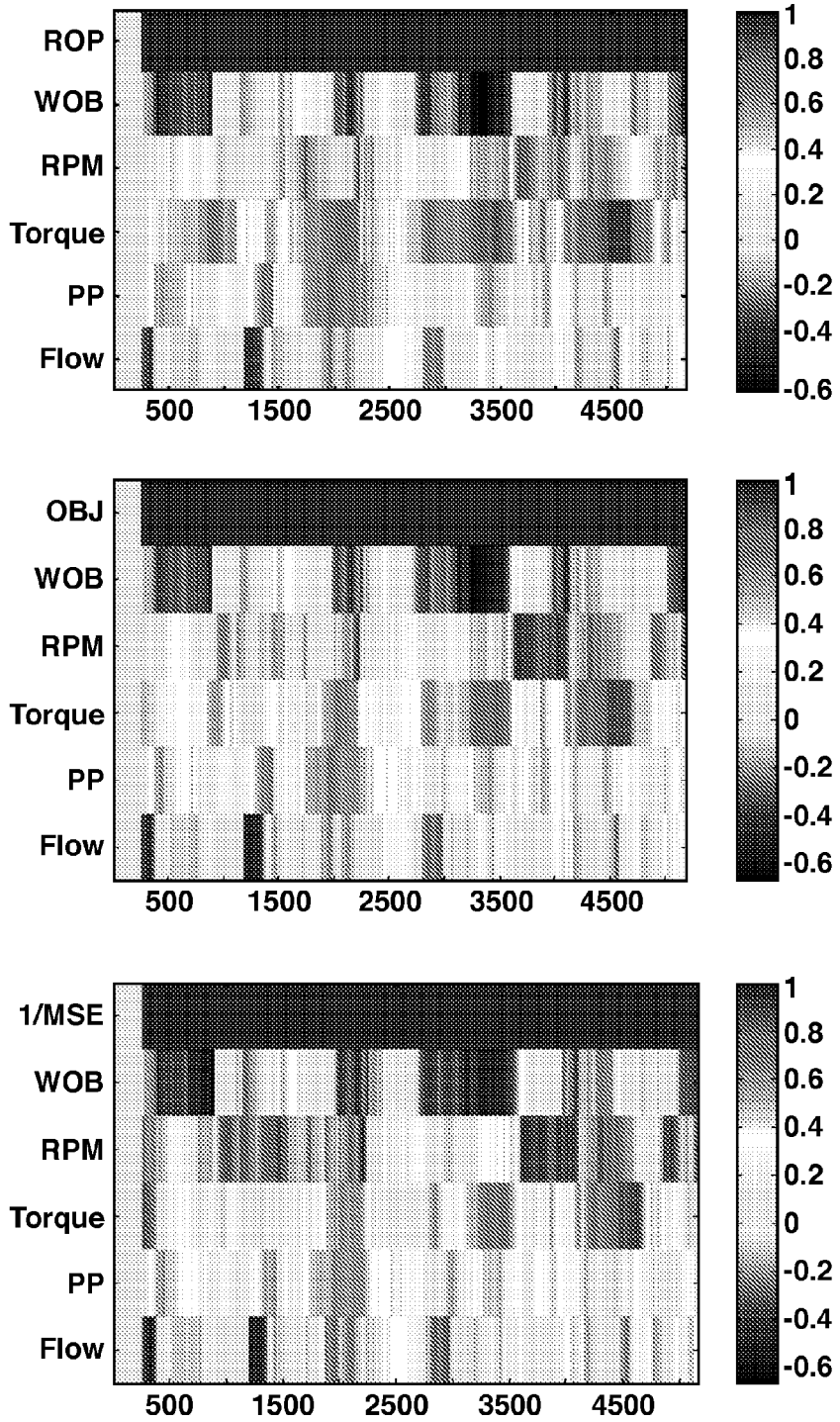
FIG. 15 shows a correlation history of drilling parameters to ROP; a correlation history of drilling parameters to an objective function (OBJ), and a correlation history of drilling parameters to MSE.

The following two examples are done to compare the effect of using ROP and the ROP-to-MSE ratio as objective functions. To avoid singular values, we used (1+ROP)/(1+MSE) instead of ROP/MSE in this experiment. A third example is shown in FIG. 15. The top plot shows correlation history of drilling parameters to ROP and the middle plot shows correlation history of drilling parameters to (1+ROP)/(1+MSE), which is denoted as OBJ in this case. The patterns in these two plots are almost identical, indicating that the operational recommendations from the present systems and methods will be similar using either objective function. This is confirmed by the correlation history to MSE in the bottom plot. The correlation history to inverse of MSE also matched the ROP correlation history.

However, the situation observed in FIG. 15 and the third example does not hold universally. As we can see from the fourth example (FIG. 16), in certain scenarios, contradicting operational recommendations could be generated depending on the selected objective function. In this example, the ROP correlation history differs from the correlation history of OBJ. Without being bound by theory, the difference is believed to be caused by competing effects in MSE and ROP. Increasing ROP and decreasing MSE in some segments of this dataset requires different adjustments to the drilling parameters. This observation demonstrates the utility of the ROP-to-MSE ratio, which may be a more robust objective function. If recommendations from the ROP correlation history were used, it might cause an undesirable increase in MSE.

Finally, two examples are provided to illustrate the utility of the objective function in equation (3), first presented above and represented here for reference:

$$OBJ(MSE, ROP) = \frac{\delta + \Delta ROP/ROP}{\delta + \Delta MSE/MSE}. \tag{3}$$

Figure 16:
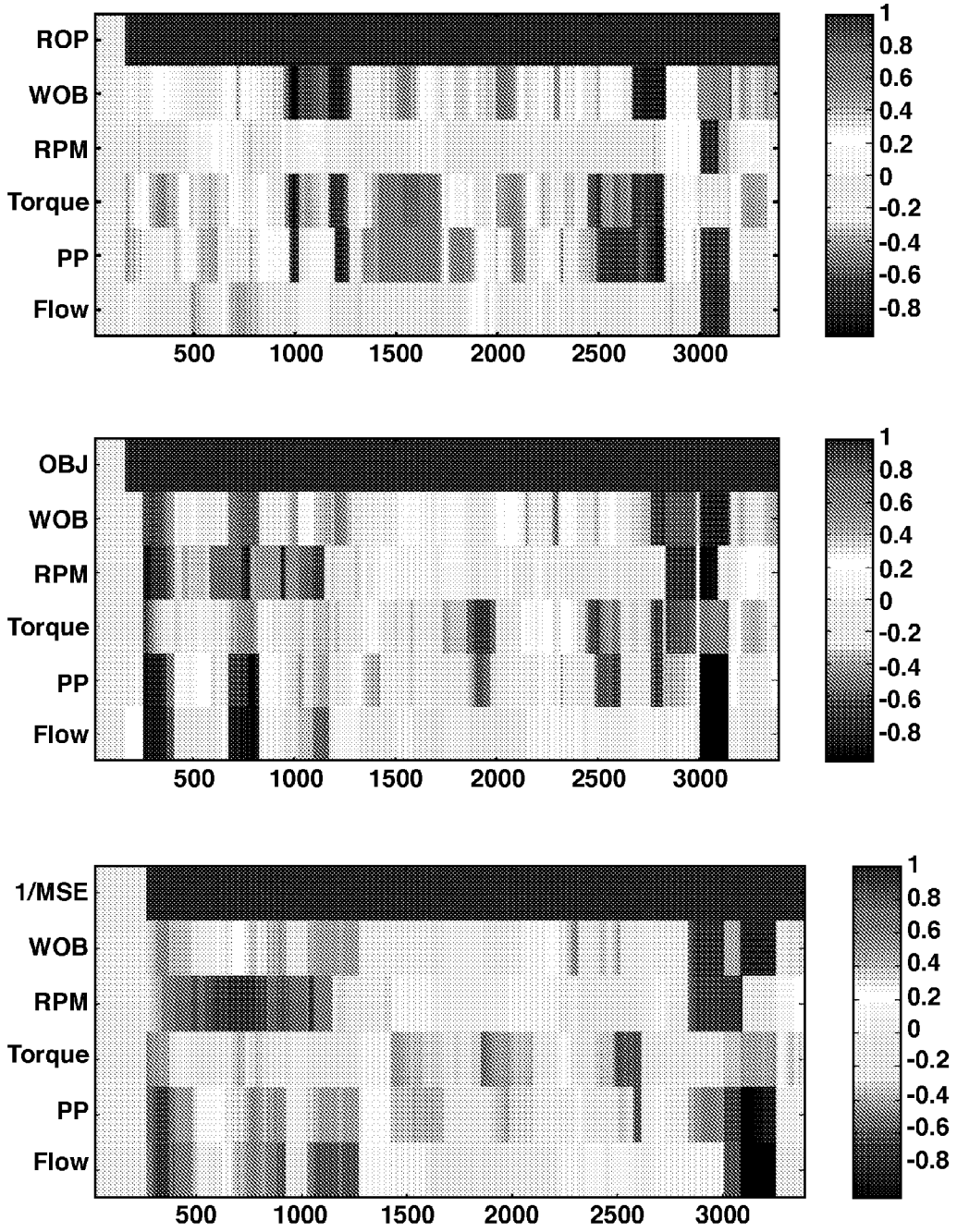
FIG. 16 provides additional correlation histories illustrating the impact of different objective functions.
Figure 17:
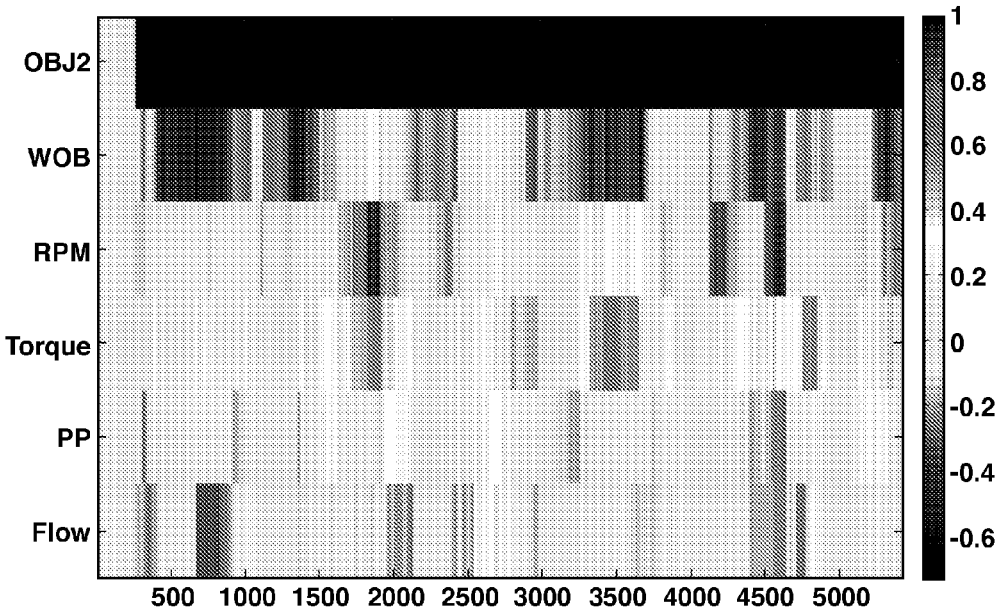
FIG. 17 provides a correlation history of drilling parameters to a particular objective function.
Figure 18:
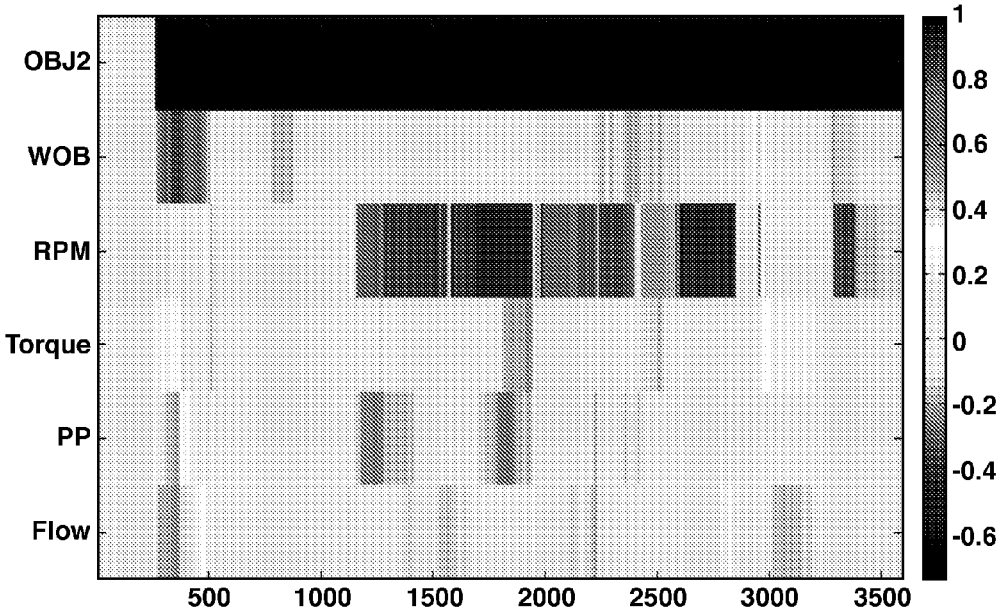
FIG. 18 provides another correlation history of drilling parameters to a particular objective function.

In FIGS. 17 and 18, the objective function in equation (3) is applied to the same data sets as in FIGS. 15 and 16, respectively. As we can see, the patterns in the statistically correlated output have changed rather significantly. This is because equation (3) is measuring something quite different from the other objective functions. The goal of this objective function is to maximize the percentage gain in ROP per unit percentage increase of MSE. This configuration of the objective function provides one example of the relationships and statistical analyses that can be utilized to improve the generated operational recommendations, and in some implementations result in automated determination of operational updates. Other relationships may be developed and/or implemented.

Figure 19:
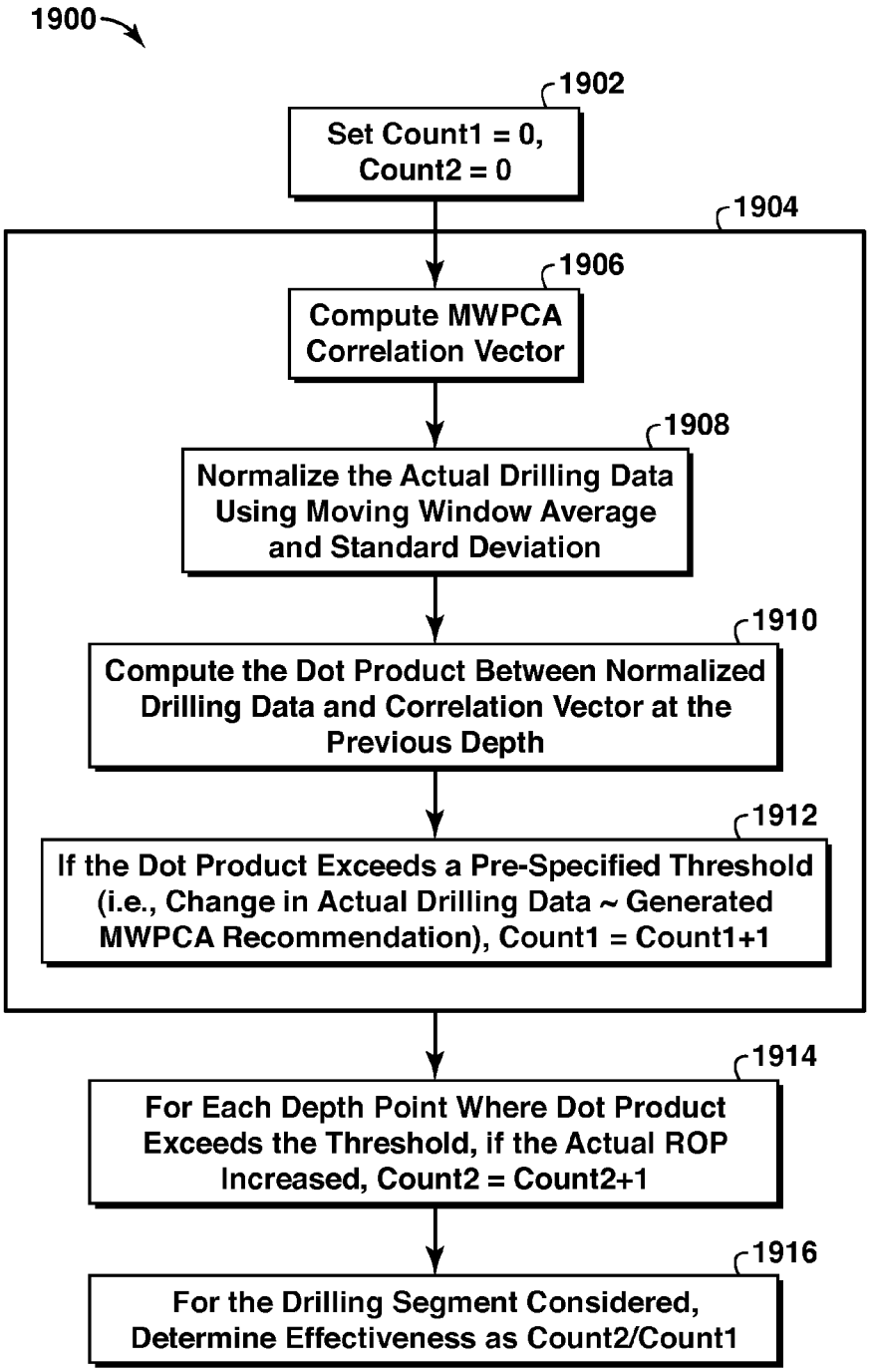
FIG. 19 is a flow chart of a validation algorithm.

Continuing with the discussion of experimental results, experiments were conducted to test the validity of the generated operational recommendations. FIG. 19 schematically illustrates a self-validation algorithm 1900 developed using actual drilling data. In this validation algorithm, Count1 counts the number of occurrences in actual drilling data where changes in the recorded drilling parameters are close to the operational recommendations that would have been suggested by the present systems and methods. Count2 counts, among all occurrences included in Count1, the number of occurrences where the objective function, in this case ROP, actually increased. The ratio between these two is one indicator of the effectiveness of the present systems and methods. As indicated in FIG. 19, the validation method begins at 1902 by setting count1=0 and count2=0. Then, for each depth point in the drilling segment, a comparison step 1904 is conducted. The comparison 1904 begins by computing a MWPCA correlation vector 1906 (or other form of correlation vector). The actual drilling data is then normalized at 1908 using moving window averages and standard deviations. The manner in which the actual data is normalized may depend on the manner in which the correlation vector 1906 is computed. A dot product is computed at 1910 between the normalized drilling data and the correlation vector at the previous depth. If the dot product exceeds a pre-specified threshold, the count1=count1+1, as illustrated at 1912. Stated more simply, the value of count1 increases by one for each depth point at which the correlation vector and the normalized data are within a margin of difference, or are sufficiently similar. Then for each depth point where the threshold was satisfied (i.e., where the actual data, or the actions of the operator, corresponds to the operational recommendations that would have been recommended by the present systems), count2 is increased by one for each time that the ROP increased, such as at 1914. In other words, when the actions that correspond to what the present systems would have recommended actually results in an improved ROP, the count2 is increased. Finally, at 1916, the effectiveness of the present methods is evaluated or determined by dividing the count2 by the count1.

Figure 20:
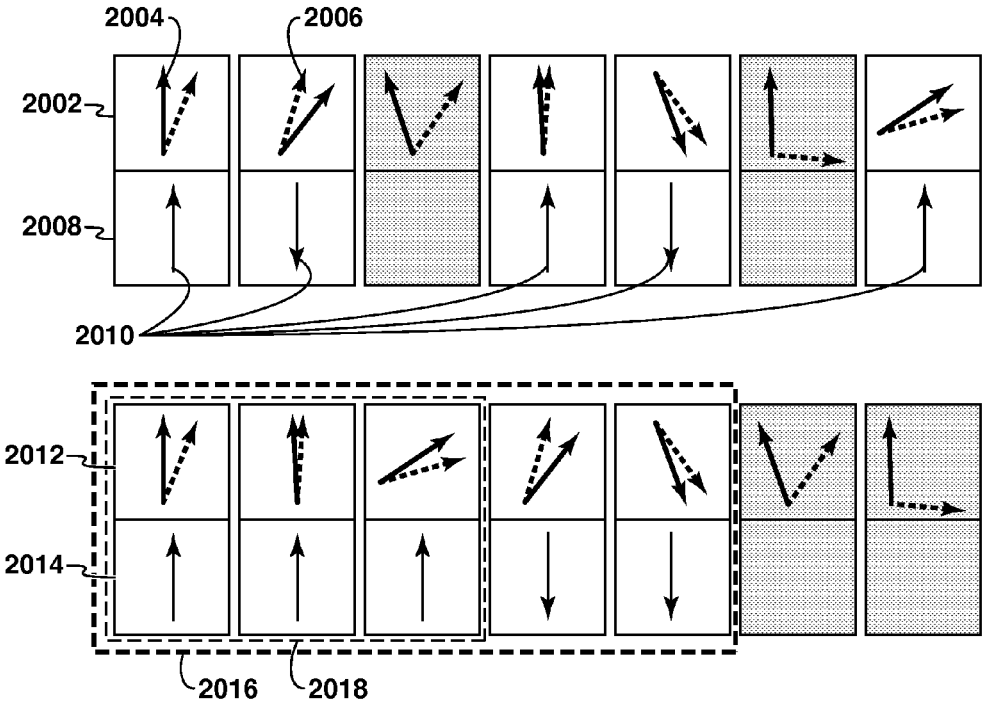
FIG. 20 is a graphical illustration of the validation algorithm.

FIG. 20 provides a graphical illustration of this method for evaluating the effectiveness of the present systems and methods. The top row of vectors 2002 is an interval of analysis, and the solid arrows 2004 indicate the direction of the actual change in drilling parameters. The dashed arrows 2006 show the change that would have been recommended by the present systems and methods to increase ROP. When these vectors are sufficiently close (e.g., the dot product is greater than 0.8), then it is considered to be a valid comparison interval. Those intervals in which there is too much difference are shaded and are not used in this analysis. When the actual change resulted in an increase in ROP over the next interval, the second row 2008 shows an arrow 2010 pointing upwards. However, when the change caused a decrease in ROP, the arrow 2010 points down. The last two rows 2012, 2014 in the chart shows how these data are evaluated, wherein all the valid evaluation intervals 2016 result in incrementing the "count 1," and the corresponding times for which the ROP increased 2018 caused "count2" to increase. Then the effectiveness of the present drilling advisory system and methods is then given as the ratio of count2 to count1.

In the table below, the "Benchmark Performance" is the overall frequency of ROP increase in the entire well dataset, and the "DAS Performance" is the frequency of ROP increase among the data records where the actual changes in drilling variables are at least 80% similar to the operational recommendations that would have been generated by the present systems and methods.

| Data Set | Well 1 | Well 2 | Well 3 | Well 4 | Well 5 | Well 6 |
|---|---|---|---|---|---|---|
| Benchmark Performance | 42% | 47% | 42% | 45% | 45% | 40% |
| DAS Performance | 70% | 69% | 72% | 57% | 84% | 82% |

The overall performance of the current generated operational recommendations is significantly higher than the benchmark, indicating that the method is likely to be very successful when employed during ongoing drilling operations.

While the present techniques of the invention may be susceptible to various modifications and alternative forms, the exemplary embodiments discussed above have been shown by way of example. However, it should again be understood that the invention is not intended to be limited to the particular embodiments disclosed herein. Indeed, the present techniques of the invention are to cover all modifications, equivalents, and alternatives falling within the spirit and scope of the invention as defined by the following appended claims.

In the present disclosure, several of the illustrative, non-exclusive examples of methods have been discussed and/or presented in the context of flow diagrams, or flow charts, in which the methods are shown and described as a series of blocks, or steps. Unless specifically set forth in the accompanying description, it is within the scope of the present disclosure that the order of the blocks may vary from the illustrated order in the flow diagram, including with two or more of the blocks (or steps) occurring in a different order and/or concurrently. It is within the scope of the present disclosure that the blocks, or steps, may be implemented as logic, which also may be described as implementing the blocks, or steps, as logics. In some applications, the blocks, or steps, may represent expressions and/or actions to be performed by functionally equivalent circuits or other logic devices. The illustrated blocks may, but are not required to, represent executable instructions that cause a computer, processor, and/or other logic device to respond, to perform an action, to change states, to generate an output or display, and/or to make decisions.

As used herein, the term "and/or" placed between a first entity and a second entity means one of (1) the first entity, (2) the second entity, and (3) the first entity and the second entity. Multiple entities listed with "and/or" should be construed in the same manner, i.e., "one or more" of the entities so conjoined. Other entities may optionally be present other than the entities specifically identified by the "and/or" clause, whether related or unrelated to those entities specifically identified. Thus, as a non-limiting example, a reference to "A and/or B", when used in conjunction with open-ended language such as "comprising" can refer, in one embodiment, to A only (optionally including entities, other than B); in another embodiment, to B only (optionally including entities other than A); in yet another embodiment, to both A and B (optionally including other entities). These entities may refer to elements, actions, structures, steps, operations, values, and the like.

As used herein, the phrase "at least one," in reference to a list of one or more entities should be understood to mean at least one entity selected from any one or more of the entity in the list of entities, but not necessarily including at least one of each and every entity specifically listed within the list of entities and not excluding any combinations of entities in the list of entities. This definition also allows that entities may optionally be present other than the entities specifically identified within the list of entities to which the phrase "at least one" refers, whether related or unrelated to those entities specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including entities other than B); in another embodiment, to at least one, optionally including more than one, B, with no A present (and optionally including entities other than A); in yet another embodiment, to at least one, optionally including more than one, A, and at least one, optionally including more than one, B (and optionally including other entities). In other words, the phrases "at least one", "one or more", and "and/or" are open-ended expressions that are both conjunctive and disjunctive in operation. For example, each of the expressions "at least one of A, B and C", "at least one of A, B, or C", "one or more of A, B, and C", "one or more of A, B, or C" and "A, B, and/or C" may mean A alone, B alone, C alone, A and B together, A and C together, B and C together, A, B and C together, and optionally any of the above in combination with at least one other entity.

Illustrative, non-exclusive examples of systems and methods according to the present disclosure are presented in the following numbered paragraphs. It is within the scope of the present disclosure that the individual steps of the methods recited herein, including in the following numbered paragraphs, may additionally or alternatively be referred to as a "step for" performing the recited action.

1. A method of drilling a wellbore, the method comprising:

receiving data regarding drilling parameters characterizing ongoing wellbore drilling operations; wherein at least two of the drilling parameters are controllable;

utilizing a statistical model to identify at least two controllable drilling parameters having significant correlation to one or more drilling performance measurements;

generating operational recommendations for at least two controllable drilling parameters; wherein the operational recommendations are selected to optimize one or more drilling performance measurements;

determining operational updates to at least one controllable drilling parameter based at least in part on the generated operational recommendations; and implementing at least one of the determined operational updates in the ongoing drilling operations.

2. The method of paragraph 1, wherein the statistical model is a correlation model.

2a. The method of any preceding paragraph, wherein the one or more drilling performance measurements are objective functions based on one or more of: rate of penetration, mechanical specific energy, and mathematical combinations thereof.

3. The method of paragraph 1, wherein the statistical model is a windowed principal component analysis model adapted to update the identification of significantly correlated parameters at least periodically during the ongoing drilling operations.

4. The method of paragraph 3, wherein the generated operational recommendations provide at least one of qualitative and quantitative recommendations of operational changes in at least one controllable drilling parameter.

5. The method of any preceding paragraph, further comprising conducting at least one hydrocarbon production-related operation in the wellbore; wherein the at least one hydrocarbon production-related operation is selected from the group comprising: injection operations, treatment operations, and production operations.

6. The method of any preceding paragraph, wherein a computer-based system is used to utilize the statistical model and to generate operational recommendations, and wherein the generated operational recommendations are presented to a user for consideration.

7. The method of paragraph 6, wherein at least one of the determined operational updates is implemented in the ongoing drilling operation at least substantially automatically.

8. The method of any preceding paragraph, wherein the one or more drilling performance measurements are objective functions based on one or more of: rate of penetration, mechanical specific energy, weight on bit, drillstring rotation rate, bit rotation rate, torque applied to the drillstring, torque applied to the bit, vibration measurements, hydraulic horsepower, and mathematical combinations thereof.

9. The method of any preceding paragraph, wherein the received data is temporarily accumulated in a moving analysis window, and wherein the statistical model utilizes at least a portion of the data in the moving analysis window.

10. The method of paragraph 9, wherein the analysis window accumulates data based on at least one of time and depth for a length of time and/or depth; and wherein the length of the analysis window is selected to provide a stable statistical model and to enable identification of lithology changes.

11. The method of paragraph 9, wherein the received data is temporarily accumulated in a pattern detection window before passing into the analysis window; and further comprising:

developing a parameter space based at least in part on data in the analysis window and the statistical model;

developing one or more principal vectors, at least substantially in real-time, based at least in part on the received data in the pattern detection window during the ongoing drilling operations, wherein the one or more principal vector characterize the received data in the pattern detection window;

calculating one or more residual vectors based at least in part on the one or more principal vectors and the parameter space; and comparing the one or more residual vectors against threshold values to determine whether the one or more principal vectors are abnormal.

12. The method of paragraph 11, wherein two or more abnormal principal vectors are clustered to identify an occurrence of an abnormal event during the drilling operation.

13. The method of paragraph 12, further comprising utilizing the statistical model in association with the identification of an abnormal event to update the identification of at least two drilling parameters having significant correlation to one or more drilling performance measurements.

14. The method of paragraph 13, wherein utilizing the statistical model to update the identified drilling parameters comprises: 1) emptying the analysis window of data upon identification of an abnormal event, 2) populating the analysis window with received data over time, 3) identifying at least two controllable drilling parameters having significant correlation to one or more drilling performance measurements, and 4) repeating the generating, determining, and implementing steps during the ongoing drilling operation; and wherein generating operational recommendations for at least two controllable drilling parameters is based at least in part on historical data while the analysis window is being populated with received drilling performance measurements.

15. The method of paragraph 12, wherein the clustered abnormal principal vectors has a signature, and wherein the signature from the clustered principal vectors is compared against benchmark signatures to identify a type of event occurring during the drilling operation.

16. The method of paragraph 15, further comprising modifying at least one aspect of the ongoing drilling operations based at least in part on the type of event occurring during the drilling operation.

17. A computer-based system for use in association with drilling operations, the computer-based system comprising:

a processor adapted to execute instructions;

a storage medium in communication with the processor; and at least one instruction set accessible by the processor and saved in the storage medium; wherein the at least one instruction set is adapted to:

receive data regarding drilling parameters characterizing ongoing wellbore drilling operations; wherein at least two of the drilling parameters are controllable;

utilize a statistical model to identify at least two controllable drilling parameters having significant correlation to one or more drilling performance measurements;

generate operational recommendations for the at least two controllable drilling parameters, wherein the recommendations are selected to optimize one or more drilling performance measurements; and export the generated operational recommendations for consideration in controlling ongoing drilling operations.

18. The computer-based system of paragraph 17, wherein the generated operational recommendations are exported to a display for consideration by a user.

19. The computer-based system of any one of paragraphs 17-18, wherein the generated operational recommendations are exported to a control system adapted to implement at least one of the operational recommendations during the drilling operation.

20. The computer-based system of any one of paragraphs 17-19, wherein the at least one instruction set is adapted to utilize windowed principal component analysis to update the identification of significantly correlated parameters at least periodically during the ongoing drilling operations.

21. The computer-based system of paragraph 20, wherein the generated operational recommendations provide recommendations of quantitative operational changes in at least two controllable drilling parameter.

22. The computer-based system of any one of paragraphs 17-21, wherein the one or more drilling performance measurements utilized by the at least one instruction set are objective functions based on one or more of rate of penetration, mechanical specific energy, weight on bit, drillstring rotation rate, bit rotation rate, torque applied to the drillstring, torque applied to the bit, vibration measurements, hydraulic horsepower, and mathematical combinations thereof.

23. The computer-based system of any one of paragraphs 17-22, wherein the at least one instruction set is adapted to temporarily accumulate the received data in a moving analysis window, and wherein the statistical model utilizes at least a portion of the data in the moving analysis window.

24. The computer-based system of paragraph 23, wherein the at least one instruction set is further adapted to:

develop a parameter space based at least in part on data in the analysis window and the statistical model;

accumulate received data temporarily in a pattern detection window before passing into the analysis window;

develop one or more principal vectors, substantially in real-time during the ongoing drilling operations, based at least in part on the received data in the pattern detection window, wherein the one or more principal vectors characterize the received data in the pattern detection window;

calculate one or more residual vectors based at least in part on the one or more principal vectors and the parameter space; and compare one or more residual vectors against threshold values to determine whether the one or more principal vectors are abnormal.

25. The computer-based system of paragraph 24, wherein the at least one instruction set is adapted to cluster two or more abnormal principal vectors and to identify an abnormal event during the drilling operation based at least in part on the clustered principal vectors.

26. The computer-based system of paragraph 25, wherein the at least one instruction set is adapted to update the identification of the parameters having significant correlation to one or more drilling performance measurements.

27. The computer-based system of paragraph 26, wherein updating the identification of the parameters providing the correlation model comprises: 1) emptying the analysis window of data upon identification of an abnormal event, 2) populating the analysis window with received data over time, and 3) identifying at least two controllable drilling parameters having significant correlation to one or more drilling performance measurements; and 4) repeating the generating and exporting steps during the ongoing drilling operation; and wherein generating operational recommendations to the at least two controllable drilling parameters is based at least in part on historical data while the analysis window is being populated with received data.

28. The computer-based system of paragraph 25, wherein the clustered abnormal principal vectors has a signature, and wherein at least one instruction set is adapted to compare the signature from the clustered principal vectors against benchmark signatures to identify a type of event occurring during the drilling operation.

29. A drilling rig system comprising:

a communication system adapted to receive data regarding at least two drilling parameters relevant to ongoing wellbore drilling operations;

a computer-based system according to any one of paragraphs 17-28; and an output system adapted to communicate the generated operational recommendations for consideration in controlling drilling operations.

30. The drilling rig system of paragraph 29, further comprising a control system adapted to determine operational updates based at least in part on the generated operational recommendations and to implement at least one of the determined operational updates during the drilling operation.

31. The drilling rig system of paragraph 30 wherein the control system is adapted to implement at least one of the determined operational updates at least substantially automatically.

32. A drilling rig system comprising:

a communication system adapted to receive data regarding at least two drilling parameters relevant to ongoing wellbore drilling operations;

a computer-based system adapted to perform the method according to any one of paragraphs 1-16; and an output system adapted to communicate the generated operational recommendations for consideration in controlling drilling operations.

33. A method for extracting hydrocarbons from a subsurface region, the method comprising:

drilling a well implementing the method of any one of paragraphs 1-16 to reach a subsurface region in fluid communication with a source of hydrocarbons; and extracting hydrocarbons from the subsurface region.

INDUSTRIAL APPLICABILITY

The systems and methods described herein are applicable to the oil and gas industry.

It is believed that the disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions and/or properties disclosed herein. Similarly, where the claims recite "a" or "a first" element or the equivalent thereof, such claims should be understood to include incorporation of one or more such elements, neither requiring nor excluding two or more such elements.

It is believed that the following claims particularly point out certain combinations and subcombinations that are directed to one of the disclosed inventions and are novel and non-obvious. Inventions embodied in other combinations and subcombinations of features, functions, elements and/or properties may be claimed through amendment of the present claims or presentation of new claims in this or a related application. Such amended or new claims, whether they are directed to a different invention or directed to the same invention, whether different, broader, narrower, or equal in scope to the original claims, are also regarded as included within the subject matter of the inventions of the present disclosure.

What is claimed is:

1. A method of drilling a wellbore, the method comprising:

receiving surface measurement data regarding drilling parameters characterizing ongoing wellbore drilling operations, wherein at least one of the drilling parameters is controllable;

determining rate of penetration (ROP) and mechanical specific energy (MSE) utilizing the received surface measurement data; utilizing a computer processor to calculate (i) a drilling performance measurement embodied in an objective function comprising a relationship between the determined ROP and the determined MSE, wherein the objective function comprises at least one of;

$$OBJ(MSE, ROP) = \frac{\delta + \Delta ROP/ROP_o}{\delta + \Delta MSE/MSE_o}. \quad \text{a}$$

$$OBJ(MSE, ROP) = \frac{\delta + \Delta ROP/ROP}{\delta + \Delta MSE/MSE}. \quad \text{b}$$

$$OBJ(MSE, SS, ROP) = \frac{\delta + ROP/ROP_o}{\delta + MSE/MSE_o + SS/SS_o}. \quad \text{c}$$

$$OBJ(MSE, SS, ROP) = \frac{\delta + \Delta ROP/ROP}{\delta + \Delta MSE/MSE + \Delta SS/SS}; \quad \text{d}$$

wherein δ factor is added to the objective function to avoid a trivial denominator, SS is the stick slip severity, $ROP_0$, $MSE_0$ and $SS_0$ are the nominal values for ROP, MSE and SS and are used in the objective function to provide dimensionless values, and ΔROP, ΔMSE and ΔSS are changes in ROP, MSE and SS between a current and a previous time step, or between a current and a previous depth location, and torsional SS can be either real time stick slip measurements transmitted from a downhole vibration measurement tool or a model prediction calculated from a surface torque and a drillstring geometry; and (ii) a mathematical correlation between the at least one controllable drilling parameters and the calculated drilling performance measurements of step (i);

generating operational recommendations based upon the mathematical correlation for the at least one controllable drilling parameter; wherein the operational recommendations are selected to optimize the objective function of (i);

determining operational updates to the at least one controllable drilling parameter based at least in part on the generated operational recommendations; and implementing at least one of the determined operational updates in the ongoing drilling operations.

2. The method of claim 1, wherein the at least one controllable drilling parameter comprises at least one of weight-on-bit (WOB), drillstring rotation rate (RPM), torque, and drilling fluid circulation rate.

3. The method of claim 1, wherein the objective function further incorporates information pertaining to one or more of: rate of penetration, drill string vibration, stick-slip, and mathematical combinations thereof.

4. The method of claim 1, wherein the mathematical correlation coefficient is calculated using principal component analysis (PCA) using the at least one controllable drilling parameter and the objective function as inputs during ongoing drilling operations.

5. The method of claim 4, wherein the generated operational recommendations provide quantitative recommendations of operational changes in at least one controllable drilling parameter.

6. The method of claim 1, further comprising conducting at least one hydrocarbon production-related operation in the wellbore; wherein the at least one hydrocarbon production-related operation is selected from the group consisting of: injection operations, treatment operations, and production operations.

7. The method of claim 1, wherein a computer-based system uses the mathematical correlation to generate operational recommendations, and wherein the generated operational recommendations are presented to a user or drilling control program for consideration.

8. The method of claim 7, wherein at least one of the presented operational updates is implemented in the ongoing drilling operation at least substantially automatically by the drilling control program.

9. The method of claim 1, wherein the objective function is based on one or more of: rate of penetration, mechanical specific energy, weight on bit, drillstring rotation rate, bit rotation rate, torque applied to the drillstring, torque applied to the bit, vibration measurements, hydraulic horsepower, and mathematical combinations thereof.

10. The method of claim 1, wherein the received data is temporarily accumulated in a moving analysis window, and wherein the mathematical correlation is presented in a moving analysis window.

11. The method of claim 10, wherein the analysis window accumulates data based on at least one of time and depth for a length of time and/or depth; and wherein the length of the analysis window is selected to enable identification of lithology changes.

12. The method of claim 10, wherein the received data is temporarily accumulated in a pattern detection window before passing into the analysis window; and further comprising:

developing a parameter space based at least in part on data in the analysis window;

developing one or more principal vectors, at least substantially in real-time, based at least in part on the received data in the pattern detection window during the ongoing drilling operations, wherein the one or more principal vector characterize the received data in the pattern detection window;

calculating one or more residual vectors based at least in part on the one or more principal vectors and the parameter space; and comparing the one or more residual vectors against threshold values to determine whether the one or more principal vectors are abnormal.

13. The method of claim 12, wherein two or more abnormal principal vectors are clustered to identify an occurrence of an abnormal event during the drilling operation.

14. The method of claim 13, wherein the clustered abnormal principal vectors have a signature, and wherein the signature from the clustered principal vectors is compared against benchmark signatures to identify a type of event occurring during the drilling operation.

15. The method of claim 1, further comprising utilizing the mathematical correlation in association with identification of an abnormal event.

16. The method of claim 15, wherein utilizing the mathematical correlation to update the identified drilling parameters including: 1) emptying the analysis window of data upon identification of an abnormal event, 2) populating the analysis window with received data over time, 3) identifying at least one controllable drilling parameter having significant correlation to an objective function incorporating two or more drilling performance measurements, and 4) repeating the generating, determining, and implementing steps during the ongoing drilling operation; and wherein generating operational recommendations for at least one controllable drilling parameter is based at least in part on historical data while the analysis window is being populated with received data.

17. The method of claim 1, wherein the mathematical correlation is a quantitative indication reflecting a value within a range of from −1 to +1, inclusive.

18. A computer-based system for use in association with drilling operations, the computer-based system comprising:

A processor adapted to execute instructions;

A storage medium in communication with the processor; and

At least one instruction set accessible by the processor and saved in the storage medium; wherein the at least one instruction set is adapted to:

receive surface measurement data regarding drilling parameters characterizing ongoing wellbore drilling operations, wherein at least one of the drilling parameters is controllable;

determining rate of penetration (ROP) and mechanical specific energy (MSE) utilizing the received surface measurement data; utilizing the computer processor running to calculate (i) a drilling performance measurement embodied in an objective function comprising a relationship between the determined ROP and the determined MSE, wherein the objective function comprises at least one of;

$$OBJ(MSE, ROP) = \frac{\delta + \Delta ROP/ROP_o}{\delta + \Delta MSE/MSE_o}. \quad \text{a}$$

$$OBJ(MSE, ROP) = \frac{\delta + \Delta ROP/ROP}{\delta + \Delta MSE/MSE}. \quad \text{b}$$

$$OBJ(MSE, SS, ROP) = \frac{\delta + ROP/ROP_o}{\delta + MSE/MSE_o + SS/SS_o}. \quad \text{c}$$

$$OBJ(MSE, SS, ROP) = \frac{\delta + \Delta ROP/ROP}{\delta + \Delta MSE/MSE + \Delta SS/SS}, \quad \text{(ii)}$$

wherein δ factor is added to the objective function to avoid a trivial denominator, SS is the stick slip severity, $ROP_0$, $MSE_0$ and $SS_0$ are the nominal values for ROP, MSE and SS and are used in the objective function to provide dimensionless values, and ΔROP, ΔMSE and ΔSS are changes in ROP, MSE and SS between a current and a previous time step, or between a current and a previous depth location, and torsional SS can be either real time stick slip measurements transmitted from a downhole vibration measurement tool or a model prediction calculated from a surface torque and a drillstring geometry; and (ii) a mathematical correlation between the at least one controllable drilling parameters and the calculated drilling performance measurements of step (i);

generating operational recommendations based upon the mathematical correlation for the at least one controllable drilling parameter; wherein the operational recommendations are selected to optimize the objective function of (i);

determining operational updates to the at least one controllable drilling parameter based at least in part on the generated operational recommendations; and implementing at least one of the determined operational updates in the ongoing drilling operations.

19. The computer-based system of claim 18, wherein the generated operational recommendations are exported to a display for consideration by a user.

20. The computer-based system of claim 18, wherein the generated operational recommendations are exported to a control system adapted to implement at least one of the operational recommendations during the drilling operation.

21. The computer-based system of claim 18, wherein the at least one instruction set is adapted to utilize windowed principal component analysis to update the identification of significantly correlated parameters at least periodically during the ongoing drilling operations.

22. The computer-based system of claim 21, wherein the generated operational recommendations provide recommendations of quantitative operational changes in at least one controllable drilling parameter.

23. The computer-based system of claim 18, wherein the objective function utilized by the at least one instruction set is based on one or more of: rate of penetration, mechanical specific energy, weight on bit, drillstring rotation rate, bit rotation rate, torque applied to the drillstring, torque applied to the bit, vibration measurements, hydraulic horsepower, and mathematical combinations thereof.

24. The computer-based system of claim 18, wherein the at least one instruction set is adapted to temporarily accumulate the received data in a moving analysis window, and wherein the quantitative value of the mathematical correlation is indicated within the window.

25. The computer-based system of claim 24, wherein the at least one instruction set is further adapted to:

develop a parameter space based at least in part on data used to determine the mathematical correlation in the analysis window;

accumulate received data temporarily in a pattern detection window before passing into the analysis window;

develop one or more principal vectors, substantially in real-time during the ongoing drilling operations, based at least in part on the received data in the pattern detection window, wherein the one or more principal vectors characterize the received data in the pattern detection window;

calculate one or more residual vectors based at least in part on the one or more principal vectors and the parameter space; and compare one or more residual vectors against threshold values to determine whether the one or more principal vectors are abnormal.

26. The computer-based system of claim 25, wherein the at least one instruction set is adapted to cluster two or more abnormal principal vectors and to identify an abnormal event during the drilling operation based at least in part on the clustered principal vectors.

27. The computer-based system of claim 26, wherein the at least one instruction set is adapted to update the identification of the parameters having significant correlation to the objective function.

28. The computer-based system of claim 27, wherein updating the identification of the significantly correlated parameters comprises: 1) emptying the analysis window of data upon identification of an abnormal event, 2) populating the analysis window with received data over time, and 3) identifying at least one controllable drilling parameter having significant correlation to the objective function; and 4) repeating the generating and exporting steps during the ongoing drilling operation; and wherein generating operational recommendations to the at least one controllable drilling parameter is based at least in part on historical data while the analysis window is being populated with received data.

29. The computer-based system of claim 26, wherein the clustered abnormal principal vectors has a signature, and wherein at least one instruction set is adapted to compare the signature from the clustered principal vectors against benchmark signatures to identify a type of event occurring during the drilling operation.

30. A drilling rig system comprising:

a communication system adapted to receive data regarding at least one drilling parameter relevant to ongoing wellbore drilling operations;

a computer-based system according to claim 18; and an output system adapted to communicate the generated operational recommendations for consideration in controlling drilling operations.

31. The drilling rig system of claim 30, further comprising a control system adapted to determine operational updates based at least in part on the generated operational recommendations and to implement at least one of the determined operational updates during the drilling operation.

32. The drilling rig system of claim 31, wherein the control system is adapted to implement at least one of the determined operational updates at least substantially automatically.

* * * * *